US012385146B2

(12) United States Patent
Danyi et al.

(10) Patent No.: US 12,385,146 B2
(45) Date of Patent: Aug. 12, 2025

(54) MODULAR ELECTROLYZER STACK AND PROCESS TO CONVERT CARBON DIOXIDE TO GASEOUS PRODUCTS AT ELEVATED PRESSURE AND WITH HIGH CONVERSION RATE

(71) Applicants: SZEGEDI TUDOMÁNYEGYETEM, Szeged (HU); eCHEMICLES ZRT., Szeged (HU)

(72) Inventors: Antal Danyi, Szeged (HU); Ferenc Darvas, Budapest (HU); Balázs Endrödi, Szeged (HU); Csaba Janáky, Szeged (HU); Richard Jones, Budapest (HU); Egon Kecsenovity, Horgos (RS); Angelika Samu, Csongrád (HU); Viktor Török, Szeged (HU)

(73) Assignees: SZEGEDI TUDOMÁNYEGYETEM, Szeged (HU); eCHEMICLES ZRT., Szeged (HU)

( * ) Notice: Subject to any disclaimer, the term of this patent is extended or adjusted under 35 U.S.C. 154(b) by 932 days.

(21) Appl. No.: 17/614,298

(22) PCT Filed: May 25, 2019

(86) PCT No.: PCT/HU2019/095001
§ 371 (c)(1),
(2) Date: Nov. 24, 2021

(87) PCT Pub. No.: WO2020/240218
PCT Pub. Date: Dec. 3, 2020

(65) Prior Publication Data

US 2022/0259745 A1 Aug. 18, 2022

(51) Int. Cl.
*C25B 1/135* (2021.01)
*C25B 1/02* (2006.01)
(Continued)

(52) U.S. Cl.
CPC ..... *C25B 1/135* (2021.01); *C25B 1/02* (2013.01); *C25B 1/23* (2021.01); *C25B 9/17* (2021.01);
(Continued)

(58) Field of Classification Search
CPC .. C25B 1/02; C25B 1/04; C25B 1/135; C25B 1/23; C25B 9/17–23; C25B 9/19;
(Continued)

(56) References Cited

U.S. PATENT DOCUMENTS 4,720,331 A 1/1988 Billings
5,690,797 A 11/1997 Harada
(Continued)

FOREIGN PATENT DOCUMENTS

CN 105862066 8/2016
EP 0659218 3/1997
(Continued)

OTHER PUBLICATIONS

Written Opinion of the International Searching Authority; mailed May 24, 2019 for PCT/HU2018/050036; 7 pages.
(Continued)

*Primary Examiner* — Loren C Edwards
(74) *Attorney, Agent, or Firm* — Fitch, Even, Tabin & Flannery

(57) ABSTRACT

An electrolyzer cell, electrolyzer setup, and related methods are provided for converting gaseous carbon dioxide to gas-phase products at elevated pressures with high conversion rates via electrolysis performed by the electrolyzer cell (100"). The electrolyzer cell (100") is a multi-stack $CO_2$ electrolyzer cell having individual stacks (40) that each include bipolar plate assemblies that have unique gas and fluid flow architecture formed therein.

25 Claims, 14 Drawing Sheets

(51) Int. Cl.

| | |
|---|---|
| ***C25B 1/23*** | (2021.01) |
| ***C25B 9/17*** | (2021.01) |
| ***C25B 9/60*** | (2021.01) |
| ***C25B 11/036*** | (2021.01) |
| ***C25B 11/065*** | (2021.01) |
| ***C25B 11/075*** | (2021.01) |
| ***C25B 13/00*** | (2006.01) |
| ***C25B 15/08*** | (2006.01) |

(52) U.S. Cl.
CPC ..... *C25B 9/60* (2021.01); *C25B 11/036* (2021.01); *C25B 11/065* (2021.01); *C25B 11/075* (2021.01); *C25B 13/00* (2013.01); *C25B 15/08* (2013.01)

(58) Field of Classification Search
CPC .... C25B 9/60; C25B 9/73; C25B 9/77; C25B 11/036; C25B 11/065; C25B 11/075; C25B 13/00; C25B 13/02; C25B 15/08; C25B 3/25; C25B 3/26
See application file for complete search history.

(56) References Cited

U.S. PATENT DOCUMENTS

| | | | | |
|---|---|---|---|---|
| 5,783,051 | A | 7/1998 | Hirai | |
| 6,878,244 | B2 | 4/2005 | Sioli | |
| 7,846,307 | B2 | 12/2010 | Taruya | |
| 7,951,284 | B2 | 5/2011 | Nakazawa | |
| 8,282,811 | B2 | 10/2012 | Kosek | |
| 10,208,385 | B2 | 2/2019 | Kudo | |
| 2005/0115825 | A1 | 6/2005 | Frank | |
| 2007/0015035 | A1 | 1/2007 | Izenson | |
| 2011/0042228 | A1 | 2/2011 | Hinatsu | |
| 2011/0266142 | A1 | 11/2011 | Norman | |
| 2013/0032472 | A1 | 2/2013 | Stefan | |
| 2013/0105304 | A1 | 5/2013 | Kaczur | |
| 2016/0369415 | A1 | 12/2016 | Masel | |
| 2017/0321334 | A1 | 11/2017 | Kuhl | |
| 2018/0195185 | A1 | 7/2018 | Kazarian | |
| 2018/0274109 | A1 | 9/2018 | Kudo | |
| 2019/0127865 | A1* | 5/2019 | Li | C25B 3/26 |
| 2019/0233952 | A1* | 8/2019 | Sheehan | C12G 3/04 |

FOREIGN PATENT DOCUMENTS

| | | |
|---|---|---|
| EP | 3375907 | 9/2018 |
| FR | 2466515 A1 | 4/1981 |
| WO | 2015102479 | 7/2015 |
| WO | 2017176600 | 10/2017 |
| WO | 2018071818 | 4/2018 |
| WO | 2019051609 | 3/2019 |
| WO | 2020240218 | 12/2020 |

OTHER PUBLICATIONS

International Search Report; mailed May 24, 2019, for PCT/HU2018/050036; 3 pages.

International Preliminary Report on Patentability; completed Jan. 20, 2021, for PCT/HU2018/050036; 8 pages.

Marcelo Carmo et al: "A comprehensive review on PEM water electrolysis", International Journal of Hydrogen Energy., vol. 38, No. 12, Mar. 14, 2013 (Mar. 14, 2013), pp. 4901-4934, XP055227116, GB ISSN: 0360-3199, DOI: 10.1016/j.ijhydene.2013.01.151; Abstract 3 pages. A p. 4905, paragraph 1.3.2.

International Preliminary Report on Patentability for PCT/HU2018/050036, mailed Mar. 19, 2021, 19 pages.

Marcelo Carmo et al: "A comprehensive review on PEM water electrolysis", International Journal of Hydrogen Energy., vol. 38, No. 12, Mar. 14, 2013 (Mar. 14, 2013), pp. 4901-4934, XP055227116, GB ISSN: 0360-3199, DOI: 10.1016/j.ijhydene.2013.01.151, 34 pages.

Grigoriev et al: "Hydrogen Safety Aspects Related to High-Pressure Polymer Electrolyte Membrane Water Electrolysis", International Journal of Hydrogen Energy, vol. 34, No. 14, Jul. 2009, pp. 5986-5991 (Year: 2009).

International Report on Patentability for PCT/HU2019/095001 completed Jun. 22, 2021, 5 pages.

Written Opinion of International Searching Authority for PCT/HU2019/095001, dated Dec. 3, 2020, 7 pages.

International Search Report for PCT/HU2019/095001, dated Dec. 3, 2020, 3 pages.

B. Endrödi, et al; "Continuous-Flow Electroreduction of Carbon Dioxide"; Progress in Energy and Combustion Science 62, (2017)13 , pp. 133-154.

* cited by examiner

MODULAR ELECTROLYZER STACK AND PROCESS TO CONVERT CARBON DIOXIDE TO GASEOUS PRODUCTS AT ELEVATED PRESSURE AND WITH HIGH CONVERSION RATE

CROSS REFERENCE TO RELATED APPLICATIONS

This patent application is the national phase of PCT/HU2019/095001, filed May 25, 2019.

TECHNICAL FIELD

The present invention relates to the field of generating gas-phase products at elevated pressure and with high conversion rate via electrolysis of gaseous carbon dioxide. The invention also relates, thus, to a novel modular electrolyzer stack to perform the electrolysis, and hence to convert carbon dioxide gas into various gas-phase products, preferentially ready to be used in further industrial processes as feedstock.

BACKGROUND

Carbon dioxide ($CO_2$) is a greenhouse gas; hence, using renewable energy to convert it to transportation fuels and commodity chemicals is a value-added approach to simultaneous generation of products and environmental remediation of carbon emissions. The large amounts of chemicals produced worldwide that can be potentially derived from the electrochemical reduction (and hydrogenation) of $CO_2$ highlight further the importance of this strategy. Electrosynthesis of chemicals using renewable energy (e.g. solar or wind energy) contributes to a green and more sustainable chemical industry. Polymer-electrolyte membrane (PEM) based electrolyzers are particularly attractive, due to the variety of possible $CO_2$ derived products. Several industrial entities are interested in such technologies, ranging from energy/utilities companies through cement producing and processing firms to oil and gas companies.

Similarly to PEM based water electrolyzers (i.e. $H_2/O_2$ generators), a typical configuration of a PEM based $CO_2$ electrolyzer consists of two flow-channels, one for the anolyte and another for the catholyte, separated by an ion-exchange membrane which is in direct contact with the catalysts. The cathode electrocatalyst is immobilized on a porous gas diffusion layer (GDL), which is typically in contact with a flowing liquid catholyte, while $CO_2$ gas is also fed through the GDL. This arrangement might overcome some of the known problems of the field, namely: (i) current limitation due to the low concentration of $CO_2$ at the electrode; (ii) $H^+$ crossover from the anode through the membrane, and consequent acidification of the catholyte, resulting in increased $H_2$ evolution selectivity; (iii) diffusion of products to the anode, where they are oxidized (product crossover). Although no such instrument is commercially available on the industrial scale at the moment, most components thereof (i.e. the GDLs and catalysts), as well as laboratory size setups (~5 $cm^2$ electrode size) are already available. Nevertheless, the structure of PEM based $CO_2$ electrolyzers and the operational conditions must be carefully optimized in the case of $CO_2$ electrolysis.

A comprehensive review on PEM based $CO_2$ electrolysis is provided e.g. in Progress in Energy and Combustion Science 62 (2017) pp. 133-154, wherein the parameters that influence the performance of flow $CO_2$ electrolyzers is discussed in detail. The analysis spans the basic design concepts of the electrochemical cell (either microfluidic or membrane-based), the employed materials (e.g. catalysts, support, etc.), as well as the operational conditions (e.g. type of electrolyte, role of pressure, temperature, etc.).

European Published Patent Appl. No. 3,375,907 A1 discloses a carbon dioxide electrolytic device in the form of a single cell electrolyzer that comprises an anodic part including an anode which oxidizes water or hydroxide ions to produce oxygen; a cathodic part including a cathode which reduces carbon dioxide to produce a carbon compound, a cathode solution flow path which supplies a cathode solution to the cathode, and a gas flow path which supplies carbon dioxide to the cathode; a separator which separates the anodic part and the cathodic part; and a differential pressure control unit which controls a differential pressure between a pressure of the cathode solution and a pressure of the carbon dioxide so as to adjust a production amount of the carbon dioxide produced by a reduction reaction in the cathodic part.

U.S. Published Patent Appl. No. 2018/0274109 A1 relates to a single cell carbon dioxide electrolytic device equipped with a refresh material supply unit including a gas supply unit which supplies a gaseous substance to at least one of the anode and the cathode; and a refresh control unit which stops supply of the current from the power supply and supply of carbon dioxide and an electrolytic solution, and operates the refresh material supply unit, based on request criteria of a cell output of the electrolysis cell.

U.S. Published Patent Appl. No. 2013/0105304 A1 relates to methods and systems for electrochemical conversion of carbon dioxide to organic products including formate and formic acid. An embodiment of the system includes a first electrochemical cell including a cathode compartment containing a high surface area cathode and a bicarbonate-based liquid catholyte saturated with carbon dioxide. The system also includes an anode compartment containing an anode and a liquid acidic anolyte. Said first electrochemical cell is configured to produce a product stream upon application of an electrical potential between the anode and the cathode. A further embodiment of the system may include a separate second electrochemical cell similar to the first one and in fluid connection therewith.

U.S. Published Patent Appl. No. 2016/0369415 A1 discloses catalyst layers to be used in electrochemical devices, in particular, for electrolyzers, the feed of which comprises at least one of $CO_2$ and $H_2O$. The catalyst layers comprise a catalytically active element and an ion conducting polymer. The ion conducting polymer comprises positively charged cyclic amine groups. The ion conducting polymer comprises at least one of an imidazolium, a pyridinium, a pyrazolium, a pyrrolidinium, a pyrrolium, a pyrimidium, a piperidinium, an indolium, a triazinium, and polymers thereof. The catalytically active element comprises at least one of V, Cr, Mn, Fe, Co, Ni, Cu, Sn, Zr, Nb, Mo, Ru, Rh, Pd, Ag, Cd, Hf, Ta, W, Re, Ir, Pt, Au, Hg, Al, Si, In, Tl, Pb, Bi, Sb, Te, U, Sm, Tb, La, Ce and Nd.

U.S. Published Patent Appl. No. 2017/0321334 A1 teaches a membrane electrode assembly (MEA) for use in a $CO_x$ reduction reactor. The MEA has a cathode layer comprising reduction catalyst and a first ion-conducting polymer, as well as an anode layer comprising oxidation catalyst and a second ion-conducting polymer. Between the anode and cathode layers, a PEM comprising a third ion-conducting polymer is arranged. The PEM provides ionic communication between the anode layer and the cathode layer. There is also a cathode buffer layer comprising a fourth ion-conducting polymer between the cathode layer and the PEM, the cathode buffer. There are three classes of ion-conducting polymers: anion-conductors, cation-conductors, and cation-and-anion-conductors. At least two of the first, second, third, and fourth ion-conducting polymers are from different classes of ion-conducting polymers.

International Publication Pamphlet No. WO 2017/176600 A1 relates to an electrocatalytic process for $CO_2$ conversion. The process employs a novel catalyst combination that aims to overcome one or more of the limitations of low rates, high overpotentials and low electron conversion efficiencies (namely, selectivities), low rates for catalytic reactions and high power requirements for sensors. The catalyst combination or mixture includes at least one catalytically active element in the form of supported or unsupported particles wherein the particles have an average particle size between about 0.6 nm and 100 nm, preferably between 0.6 nm and 40 nm, and most preferable between 0.6 nm and 10 nm. The catalyst combination also includes a helper polymer that can contain, for example, positively charged cyclic amine groups, such as imidazoliums or pyridiniums. The catalyst combination of a catalytically active element and a helper polymer are very useful when used in the cathode catalyst layer of a single electrochemical cell for conversion of $CO_2$ to various reaction products.

U.S. Pat. No. 10,208,385 B2 discloses a carbon dioxide electrolytic device with a single electrolyzer cell to convert $CO_2$ into various products, especially CO, wherein the cell includes a cathode, an anode, a carbon dioxide supply unit, an electrolytic solution supply unit, and a separator to separate said cathode and anode from one another. Besides the cell, the carbon dioxide electrolytic device further comprises a power supply; a reaction control unit which causes a reduction reaction and an oxidation reaction by passing an electric current from the power supply to the anode and the cathode. Said cell is fed with gaseous $CO_2$ on the cathode, and with a liquid electrolyte on at least the anode side. The gas and the liquid(s) are distributed within the cell through gas and liquid flow-paths, respectively, which are formed in the cathode and the anode current collectors.

As is clear from the aforementioned, most of the precedent art in the field of $CO_2$ electrolysis focuses on the development of new catalysts to enhance activity and product selectivity using single cell constructions. At the same time, in a simple batch-type electrochemical cell, the maximum achievable rate for the reaction is often limited by the low solubility (~30 mM) of $CO_2$ in water. Similar problems arise when a solution (catholyte) is fed to the cathode of a continuous-flow electrolyzer, hence direct $CO_2$ gas-fed (i.e. no electrolyte) electrolyzer cells would be preferred.

Hence, there would be a need for increasing the $CO_2$ conversion rate to a level of practical significance. Putting this another way, to overcome mass-transport limitations, there would be a need for a continuous-flow, direct $CO_2$ gas-fed setup and process to perform electrochemical $CO_2$ reduction with high conversion rate (e.g., current density of at least 150 mA $cm^{-2}$).

There is a wide consensus in the field that to drive this process in an economically attractive way, it is important to produce (i) any product as selectively as possible; (ii) products of economic value; and (iii) products that are easy to separate. To achieve these objects, there would, thus, be a need for electrolyzer cells/stacks that operate with:

High current density (which translates to high reaction rate);

High Faradaic efficiency for the desired product(s) (i.e. large fraction of the invested total current ($\Sigma_i j_i$) is used for product formation ($j_{product}$), hence high selectivity appears towards a given product), here $$\varepsilon_{Faradaic,product} = \frac{j_{product}}{\Sigma_i j_i} \times 100\%;$$

Low over-potential (this determines the energy efficiency of the process, defined as $$\varepsilon_{energy} = \frac{\Sigma_i (E^0_{anode,i} - E^0_{cathode,i}) \times \varepsilon_{Faradaic,i}}{V_{cell}} \times 100\%;$$

where $E^0_{anode}$ and $E^0_{cathode}$ are the standard redox potentials of the anode and cathode reactions, respectively, and $V_{cell}$ is the measured cell voltage; and High conversion efficiency (this gives the ratio of the converted $CO_2$ versus the $CO_2$ feed) defined as $$\varepsilon_{conversion} = \frac{\dot{n}_{CO_2,converted}}{\dot{n}_{CO_2,in}} \times 100\%.$$

If an electrolyzer cell/stack does not fulfil any of these points, it cannot be competitive on a practical scale with other non-electrochemical technologies.

Hence, there would also be a need for a novel $CO_2$ electrolyzer stack and process, in the case of which the stack architecture and the operational parameters are optimized in order to fulfil the above goals.

Furthermore, there would be also a need for providing, especially for industrial applications, a large-sized and cell-based modular $CO_2$ electrolyzer stack, i.e. a multi-cell electrolyzer stack that consists of more than one, preferably several electrolyzer cells, wherein said cells can be manufactured relatively simply and inexpensively.

In most cases, industrial $CO_2$-sources provide gaseous $CO_2$ at elevated pressures. Moreover, industrial processes making use of various gas-phase carbon-based substances, such as e.g. syngas, carbon monoxide, methane, ethane, ethylene, etc., as feedstocks for producing other products require the feedstocks also at elevated pressures; here, and in what follows, the term 'elevated pressure' refers to differential pressure values falling into the range of about 0 bar to at most about 30 bar.

In light of this, there would be a clear need for a $CO_2$ electrolyzer stack that withstands elevated pressures, especially at its cathodic side.

A yet further object of the present invention is to provide a $CO_2$ electrolyzer stack that can be easily and simply restructured according to needs if a change in the required production rate or even in the type of product arises.

Additional objects, as well as aspects, features and advantages, of the present invention will be set forth in the description which follows.

SUMMARY

The above goals are achieved by a continuous-flow multi-cell or multilayered electrolyzer stack as described herein. The above objects are furthermore achieved by a $CO_2$ electrolyzer setup to convert starting gaseous carbon dioxide to final gas-phase product(s). The above objects are also achieved by a method to convert gaseous carbon dioxide, $CO_2$, to at least one gas-phase product.

In particular, the invention relates to new components and a new assembly of a carbon dioxide electrolyzer stack capable of operating at elevated differential pressures with high conversion rates. It is based on the electrochemical reduction of gaseous carbon dioxide to gas-phase products (see table 1 below) and an oxidation reaction (e.g., that of water, $H_2O-2e^-=2H^++0.5\ O_2$) at the cathode and anode sides, respectively; the carbon dioxide used is preferentially humidified before its feeding into the electrolyzer stack.

TABLE 1

A few possible reactions resulting in gas-phase products in $CO_2$ electrolysis.

| Product | Reaction | Standard reduction potential (V vs. standard hydrogen electrode, at pH = 7) |
|---|---|---|
| carbon monoxide | $CO_2 + H_2O + 2e^- = CO + 2\ OH^-$ | −0.51 |
| | Hydrocarbons | |
| methane | $CO_2 + 6\ H_2O + 8\ e^- = CH_4 + 8\ OH^-$ | −0.24 |
| ethane | $2CO_2 + 10\ H_2O + 14\ e^- = C_2H_6 + 14\ OH^-$ | −0.27 |
| ethylene | $2CO_2 + 8\ H_2O + 12\ e^- = C_2H_4 + 12\ OH^-$ | −0.34 |
| | Side reaction | |
| hydrogen | $2H_2O + 2\ e^- = H_2 + 2\ OH^-$ | −0.42 |

Due to the proposed technological novelties and the modular construction, the presented electrolyzer stack architecture is highly scalable and flexible. The stack can be easily scaled, both in terms of its size/dimensions and the number of cells made use of, while maintaining pressure tolerance. Thus, based on the novel concept of multilayered configuration in the field of $CO_2$ electrolysis, a $CO_2$ electrolyzer stack is built, in which the number of cells is up to even ten or more, ranges preferably from two to seven, more preferably from three to six, and most preferably it is three, or four, or five, or six.

Furthermore, the stack architecture allows to couple the individual electrolyzer cells either in parallel or in series, or in a mixed way in terms of gas management. Surprisingly, it was found that by changing only one element of the electrolyzer stack (and rearranging others), the operation can be switched from series to parallel. Thus, the stack can be operated to achieve either extraordinary high conversion rate or conversion efficiency, upon the needs. The employed catalysts, gas diffusion layers and ion exchange membranes allow flexibility in generating different gas-phase products. This allows the application of the $CO_2$ electrolyzer stack according to the invention in various industries, such as the chemical, oil, and energy industry. It is to be noted that the present invention is not limited to $CO_2$ electrolyzer stacks only, upon appropriate routine modifications, it can be applied to other electrochemical setups (e.g., $N_2$-reduction stacks for ammonia production) as well.

In the present invention, several cells (electrocatalyst layers and membranes) are connected in series (electrically), confined by bipolar plate assemblies, functioning as anode of one cell on one side and as cathode for the subsequent cell on the other side (similar to PEM fuel cells or water electrolyzers).

The specific multi-cell stack architecture is realized by the application of two-component bipolar plate assemblies in forming said individual electrolyzer cells. Here, a first component of a certain bipolar plate assembly forms the anodic part of the cell, while the second component of said bipolar plate assembly forms the cathodic part of a cell arranged next to said cell. In this way, a series of electrolyzer cells can be formed, wherein some flow structure elements of the cathodic/anodic flow paths within the stack, i.e. cavities and channels for the gaseous flow on the cathodic part, as well as cavities and channels for the liquid flow on the anodic part of the stack, are prepared on/in and between the opposite side surfaces of the first and second components of the bipolar plate assemblies.

Furthermore, the serial/parallel flow-channel configuration is achieved by selectively forming ring shaped spacer elements, i.e. the anode side distances, which practically support subsequent bipolar plate assemblies in the electrolyzer stack when the stack is assembled, with through channels; in particular, in harmony with the modular construction, two different kinds of spacer elements are provided, a first type with a single internal gas transport channel in the peripheral portion of the spacer element, and a second type with two gas transport channels located diametrically opposite to one another in the peripheral portion of the spacer element. When assembling the electrolyzer stack, making use of the first type spacer element between subsequent bipolar plate assemblies allows the formation of a continuous gas flow path within the stack (that is, the individual cells are connected in series in terms of the stack's gas management), while making use of the second type spacer element between subsequent bipolar plate assemblies results in the formation of a gas flow path with parallel sections within the stack (that is, the cell gas flow paths in each of the individual cells are connected in parallel in terms of the stack's gas management). The use of said specific spacer elements also allows of establishing a structured gas flow path within the multilayered electrolyzer stack which can equally contain serial sections and parallel sections.

That is, the function of the bipolar plate assemblies and the end units is complex: (i) they form the current collectors which are in contact with the catalyst layers, (ii) as the reactants are fed to the catalyst layer through the channels formed in these plates, they are responsible for the reactants supply to the stack active area, and for the proper outlet of the products (iii) these contribute to the mechanical strength of the stack. Furthermore, they play a significant role in the heat management of the electrolyzer stack, too. To serve this purpose, a system of in-plane flow-channels are formed on each of said elements in a surface thereof to increase the surface area and to help the transport processes. Said flow-channels are organized into various flow-field designs of specific geometry that are specifically optimized for the first time.

A further component made use of in the $CO_2$ electrolyzer stack according to the invention is a custom designed and assembled anode side structural element made of titan (Ti) frit (Ti-frit). Said Ti-frit is made of Ti powder of different average particle size. Ti-frit is actually manufactured by pressing the Ti-particles. The anode catalyst is deposited either directly on this Ti-frit through e.g. wet-chemical synthesis, or is synthesized separately and immobilized subsequently on the Ti-frit.

As for the cathode catalyst applied in the $CO_2$ electrolyzer stack according to the invention, it is immobilized on a high surface area carbon support (i.e. the GDL), which is in direct contact of the bipolar plate assembly. $CO_2$ gas is fed to the catalyst through this GDL. At the same time, the catalyst is in direct contact with the PEM, which allows facile ion transport.

A yet further component employed within the $CO_2$ electrolyzer stack according to the invention is a pressure chamber formed within specific end units arranged at both, i.e the cathode-side and the anode-side ends of the stack. Said pressure chambers provide adaptive pressure control on the cells from both sides, thus providing uniform pressure distribution throughout the cells. This construction inhibits deformation of the stack body, and thus avoids the decrease in the contact area between the internal components. This results in a stable stack resistance even at elevated pressures. Importantly, the application of the end units eliminates the requisite of moving parts (such as pistons or valves) or elastic plastic elements as pressure controlling means within the stack. Furthermore, unlike any external pressure control, the employment of pressure chambers in said end units is inherently safe, because the pressure in the pressure chambers can never be higher than the pressure generated in the electrolyzer cells. To ensure pressure independent electrochemical performance, the pressure chambers are applied in pairs, i.e. one at the cathode-side and another one at the anode-side of the electrolyzer stack according to the invention.

BRIEF DESCRIPTION OF THE DRAWINGS

In what follows, the invention is described in detail with reference to the accompanying drawings, wherein.

DETAILED DESCRIPTION

Figure 1:
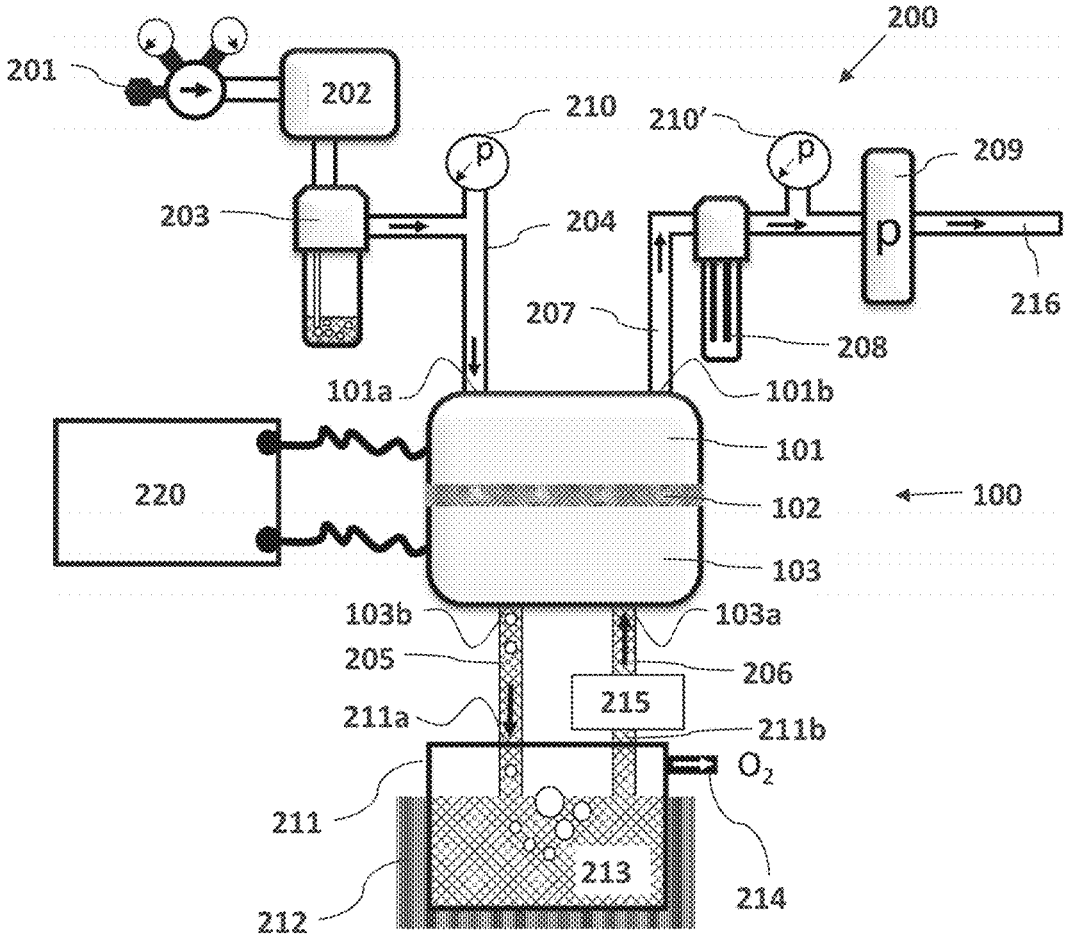
FIG. 1 illustrates simplified operation of a carbon dioxide electrolyzer setup according to the invention fed with (humidified) $CO_2$ gas on the cathode side and with tempered anolyte on the anode side of the electrolyzer cell/stack used therein.

FIG. 1 illustrates an exemplary embodiment of a $CO_2$ electrolyzer setup 200 comprising a $CO_2$ electrolyzer (electrochemical) stack 100 used to generate gaseous products at elevated pressures with high conversion rates via the electrolysis of gaseous $CO_2$ fed into the stack 100 which comprises a cathode 101 on a cathodic side, an anode 103 on an anodic side and a separator 102 to separate said cathode 101 and anode 102 from one another; here, the separator 102 is preferably a PEM element (e.g., an anion exchange membrane or a cation exchange membrane or a bipolar membrane). Said stack 100 is equipped with at least one gas inlet 101*a* and at least one gas outlet 101*b*, both being in gas connection with the cathodic side of the stack 100. Said stack 100 is also equipped with at least one fluid inlet 103*a* and at least one fluid outlet 103*b*, both being in fluid connection with the anodic side of the stack 100. The setup 200 further comprises a source 201 of gaseous $CO_2$, a humidifier 203 to humidify the gaseous $CO_2$, a power supply 220 to energize the electrochemical stack 100, an anolyte refresher unit 211 to regenerate an anolyte 213 used in the anodic side of the stack 100, a water separator 208 to remove moisture from the gaseous product(s) produced via the electrolysis of gaseous $CO_2$ in the cathodic side of the stack 100, a back pressure regulator 209 to pressurize the stack 100 to maintain an elevated pressure (up to 30 bars, preferably up to 20 bars) within the stack 100, as well as a gaseous product outlet 216 that opens into a gas-phase product receptacle (not illustrated). As the $CO_2$ source 201, either a source of pure gaseous $CO_2$ or a source that supplies $CO_2$ in the form of a gas mixture, can be used. Optionally, the setup 200 further comprises any of a mass flow controller 202 to accurately control the mass flow of the gaseous $CO_2$ fed into the cathodic side of the stack 100 and appropriate pressure gauges 210, 210' to characterize the pressure prevailing within the stack 100. The $CO_2$ source 201 is connected to the gas inlet 101*a* of the stack 100 via an appropriate pipe 204, while the product outlet 216 is connected to the gas outlet 101*b* of the stack 100 via a further pipe 207. As a result, a continuous flow-path forms from said $CO_2$ source 201 to the product outlet 216 through the cathodic side of the stack 100. The mass flow controller 202 is preferably inserted into the pipe 204 downstream of the $CO_2$ source 201. The humidifier 203 is preferably inserted into the pipe 204 downstream of the mass flow controller 202, to humidify the gaseous $CO_2$ before its entry into the stack 100. The humidifier 203 is preferably a temperature-controlled bubbling type humidifier, however, any other kind of humidifier can also be applied here. Optionally, the pressure gauge 210 is also inserted into the pipe 204 to continuously monitor the inlet pressure in the stack 100. The water separator 208 is inserted into the pipe 207 downstream of the stack 100. The back pressure regulator 209 is inserted into the pipe 207 downstream of said water separator 208. As the water separator 208 and the back pressure regulator 209 any kind of water separator and pressure regulator can be used, as is clear for a skilled person in the art. Optionally, the further pressure gauge 210' is inserted into the pipe 207 between the stack 100 and the back pressure regulator 209 to continuously monitor the outlet pressure in the stack 100. Thus, by means of the pressure gauges 210, 210', the pressure drop through the stack 100 can also be determined.

The anodic side of the stack 100 is in fluid connection through its fluid outlet 103*b* and a pipe 205 with an inlet port 211*a* of the anolyte refresher unit 211. Furthermore, the anodic side of the stack 100 is in fluid connection through its fluid inlet 103*a* and a pipe 206 with an outlet port 211*b* of the anolyte refresher unit 211. Thus, a closed continuous flow-path forms on the anodic side of the stack 100 between said anodic side and the anolyte refresher unit 211. Through this closed flow-path, an anolyte 213 is circulated by means of a pump 215 inserted preferably into the pipe 206 between the anodic side, through an appropriate system of fluidic channels formed in the anode, and the refresher unit 211 to refresh spoilt anolyte (if needed) taking place in electrochemical reaction(s) at the anodic side in the stack 100. Furthermore, to provide the possibility of venting in said anolyte refresher unit 211, said unit is also equipped with venting means 214 through which surplus gas accumulating in the refresher unit 211 separated from spoilt anolyte 213 during the process of refreshment of the anolyte 213 can leave the unit. For the optimal operation of the $CO_2$ electrolyzer setup 200, and in turn the stack 100 as well, the anolyte refresher unit 211 is in thermal coupling with appropriate tempering means 212 to adjust the temperature of the anolyte 213, that is to cool/heat it. To this end, as is clear for a skilled person in the art, any kind of tempering means, that is, cooler/heater means can be used.

As far as the electric power supply of the stack 100 is concerned, a negative pole of said power supply 220 is electrically connected with the cathodic side of the stack 100, in particular a cathode-side contact plate, while a positive pole of said power supply 220 is electrically connected with the anodic side of the stack 100, in particular an anode-side contact plate (to be discussed later in detail). Said power supply 220 can be either the grid itself or any local source of electricity, i.e. a solar, wind, nuclear one. A battery, either a disposable or a secondary one, can be equally used as the power supply 220.

In operation, the carbon dioxide (either pure, or a gas mixture) is first humidified at a controlled temperature (which is preferentially in the range of about 20° C. to about 70° C.), and then fed to the cathodic side of the stack 100. Here, there is no solution feed to the cathode. When feeding only humidified $CO_2$ gas to the cathodic side, the reactant concentration remains very high on the catalyst, and therefore high reaction rates (currents) can be achieved. Furthermore, because the lack of solution feed, no reactant is washed out unreacted with this stream. As the type of reactant has an important and complex effect on stack performance, this modification regarding the type of feed represents a significant difference in comparison with most prior art solutions. In the presented $CO_2$ electrolyzer setup 200, only gas phase products form in the electrolysis reactions that take place in the stack 100. Depending on the catalysts used in the stack 100 and the applied $CO_2$ electrolysis reactions (see Table 1) various products are obtained; as examples (i) syngas ($CO/H_2$ mixture with controlled composition) and (ii) ethylene are mentioned here. The gaseous products forming in the cathodic part, that is, within the system of flow-channels fabricated in cathode-side constructional elements (discussed later), leave the stack 100 and then are introduced into the water separator 208 to remove moisture. The anolyte 213 (employed as aqueous solution, the type of which depends on the type of separator 102 used, i.e. the applied ion-exchange membrane) is directly and continuously fed into the anodic side of the stack 100 with the pump 215. Said anolyte 213 then flows through the stack 100 in a system of flow-channels fabricated in anode-side constructional elements and collects gaseous oxygen that forms in the electrolysis reaction of $CO_2$ along its path.

When the stream of anolyte 213 leaves the stack 100, and before being recirculated into said stack 100, the oxygen content in said anolyte 213 gets released within the anolyte refresher unit 211 and then is vented out through said venting means 214. Notably, other value-added anode processes (other than water oxidation, e.g. chlorine formation or alcohol oxidation) can be coupled to $CO_2$ conversion, as is clear for a skilled person in the art; the architecture of said setup 200/stack 100 is not confined to water oxidation at all. Furthermore, during operation of the setup 200, the pressure in the stack 100 is continuously controlled by the back pressure regulator 209. Thus, contrary to most prior art solutions, the electrolyzer stack 100 actually works under continuous differential pressure.

Figure 2A:
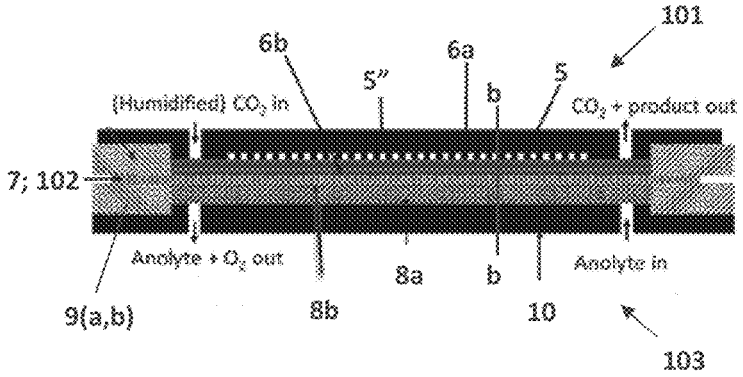
FIG. 2A is a schematic cross-sectional representation of a single-layered electrolyzer cell usable in the carbon dioxide electrolyzer setup shown in FIG. 1.
Figure 2B:
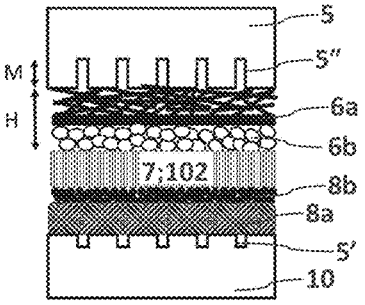
FIG. 2B is an expanded view of a part of the cell exemplified in FIG. 2A.

FIG. 2A is the schematic cross-sectional view of a single exemplary PEM electrolyzer cell that can be used in the $CO_2$ electrolyzer stack 100/setup 200 shown in FIG. 1; FIG. 2B is an expanded view of a part of the cell taken in the vicinity of the b-b line shown in FIG. 2A. Said cell comprises a PEM, in particular an ion-exchange membrane 7, 102, held in place by (i.e. cathode- and anode-side) spacer elements 9(*a, b*) arranged at opposite sides of said membrane 7 along its peripheral edge portion. The membrane 7 functions as a separator element, it separates the cathode 101 and the anode 103 (i.e. the cathodic and anodic sides) of the cell from one another. At the cathodic side, there is a layer of (cathode) catalyst 6*b* arranged adjacent to and in direct contact with the membrane 7. On the layer of the catalyst 6*b*, on a surface thereof facing away the membrane 7, a gas diffusion layer 6*a* is arranged in direct contact with said layer of catalyst 6*b*. On this gas diffusion layer 6*a*, a plate of a cathode current collector 5 is arranged in direct contact with said gas diffusion layer 6*a*.

Here, the membrane 7 is an anion exchange membrane, available under the tradenames of e.g. Fumasep, Selemion and Sustanion, just to mention a couple of examples only, which allows, in operation, the migration of hydroxide ions ($OH^-$ ions; charges, and thus current) between the cathodic and anodic sides of the cell through its bulk, while water ($H_2O$) diffusing through it from the anodic to the cathodic side takes part in the electrolytic reduction of $CO_2$ at the cathodic side. As in this case no electrons are transported through the membrane 7, said membrane 7 actually acts as a layer of electrical insulation between the cathodic and anodic sides of the cell. As is clear for a skilled person in the art, depending on the electrolytic reaction to be performed at the cathodic side, cation exchange membranes, available under the tradenames of e.g. Nafion and Aquivion, or further bipolar membranes (e.g. Fumasep FBM) can equally be employed as the membrane 7.

The cathode current collector 5, on the one hand, acts as a current distributing element, that is, it uniformly distributes the electric current received from an external power supply through a cathode-side contact plate (discussed below) over the cathode-side gas diffusion layer 6*a* and, on the other hand, provides appropriate space for the compression of said cathode-side gas diffusion layer 6*a*. The cathode current collector 5 comprises a system of in-plane flow-channels 5" of height M formed on/in a surface of the cathode current collector 5 that faces towards the membrane 7; said system of flow-channels 5" corresponds to various geometrical patterns (see e.g. FIG. 9). The patterned formation of the flow-channels 5" allows a uniform distribution of the gaseous $CO_2$ over the cathode-side gas diffusion layer 6*a*. The cathode current collector 5 is also provided with, in the form of throughout openings, an inlet for feeding gaseous $CO_2$ to the gas diffusion layer 6*a* and an outlet for discharging the gaseous product that forms at the cathodic side of the cell in the electrolysis reaction (reduction) of $CO_2$.

The cathode-side gas diffusion layer 6*a* allows, in operation, a $CO_2$ transport to the layer of cathode catalyst 6*b* in contact with the membrane 7 where reduction reaction of the gaseous $CO_2$ takes place and thus the desired product forms. The gas diffusion layer 6*a* also allows the transport of said gaseous product (in the form of a mixture also comprising the amount of non-converted $CO_2$) along the cathodic flow-channel structure towards a $CO_2$ and product outlet of the cell. To provide effective transport properties, as the cathode-side gas diffusion layer 6*a* any of a carbon cloth, carbon felt and carbon film can be used, preferably modified with a microporous layer, as is known by a skilled person in the art. As the cathode catalyst 6*b*, a plurality of catalysts can be used, the cathode catalysts applied in this case are preferably Ag/C and Cu/C catalysts. The gas diffusion layer 6*a* and the layer of cathode catalyst 6*b* have a total thickness H, as is shown in FIG. 2B, that represents cathode compartment spacing.

In turn, at the anodic side, there is a layer of anode catalyst 8*b* arranged adjacent to and in direct contact with the membrane 7; here, $IrO_x$, $RuO_x$, $NiO_x$, and $TiO_x$ are highly preferred anode catalysts. On the layer of the anode catalyst 8*b*, on a surface thereof facing away the membrane 7, an anode-side gas diffusion layer 8*a* is arranged in direct contact with said layer of anode catalyst 8*b*. Said anode-side gas diffusion layer 8*a* is formed of a layer of titan-frit (Ti-frit) in the form of pressed Ti powder of different average particle size (in the range of preferably 50-200 μm) or a layer nickel-frit (Ni-frit) in the form of pressed Ni powder of different average particle size (in the range of preferably 50-200 μm), titan-mesh (Ti-mesh) or nickel-mesh (Ni-mesh), both having a wire thickness and pore size preferably in the range of 50-200 μm, just to mention a few examples. On the anode-side gas diffusion layer 8*a*, a plate of an anode current collector 10 is arranged in direct contact with said gas diffusion layer 8*a*. The anode current collector 10 also comprises a system of flow-channels 5' formed in a surface of the anode current collector 10 that faces towards the membrane 7.

The anode current collector 10, on the one hand, acts as a current distributing element, that is, it uniformly distributes the electric current received from the external power supply through an anode-side contact plate (discussed below) over the anode-side gas diffusion layer 8*a* and, on the other hand, provides appropriate space for the compression of the anode-side gas diffusion layer 8*a*. The anode current collector 10 is also provided with, in the form of through openings, an inlet for feeding liquid anolyte to the anode-side gas diffusion layer 8*a* and an outlet for discharging the mixture of liquid anolyte and anodic products (e.g. gaseous $O_2$ if the anolyte also contains water) appearing at the anodic side of the cell in the electrolysis reactions (oxidation) of the anolyte taking place at the anodic side.

As is clear for a skilled person in the art, the cathode-side gas diffusion layer 6*a*, the layer of cathode catalyst 6*b*, the membrane 7, the layer of anode catalyst 8*b* and the anode-side gas diffusion layer 8*a* can be combined into a single unit, i.e. a membrane electrode assembly, and applied in the form of said assembly to construct a modular electrolyzer cell by arranging such a membrane electrode assembly between the cathode current collector 5 and the anode current collector 10 both in electrical contact and in gaseous/fluid communication therewith and positioning said assembly properly by the anode-side spacer elements 9*a*, 9*b*. It should be here also noted that the electrolyzer cell obtained in this way and shown in FIG. 2 is essentially a zero-gap electrolyzer cell and, as discussed below, can also be used to construct multi-cell $CO_2$ electrolyzer stacks 100" of modular structure.

Figure 3A:
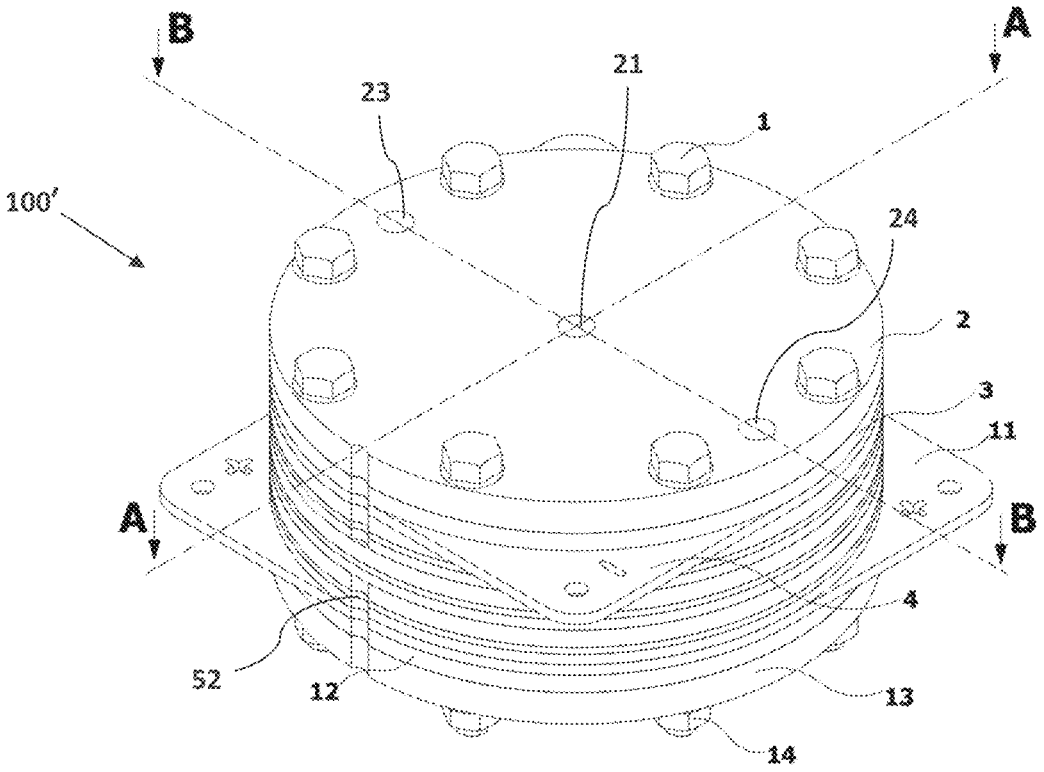
FIGS. 3A and 3B are complete upper and lower, respectively, perspective views of a specific exemplary embodiment of an electrolyzer stack according to the invention with three cells used to convert carbon dioxide gas to various gas-phase products.
Figure 3B:
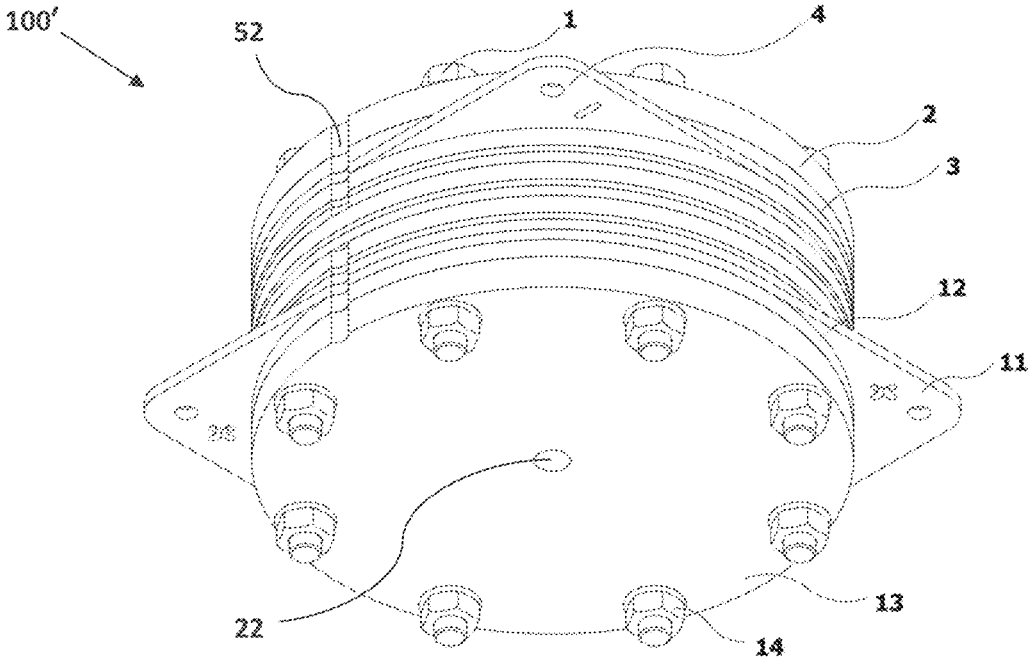
Figure 4:
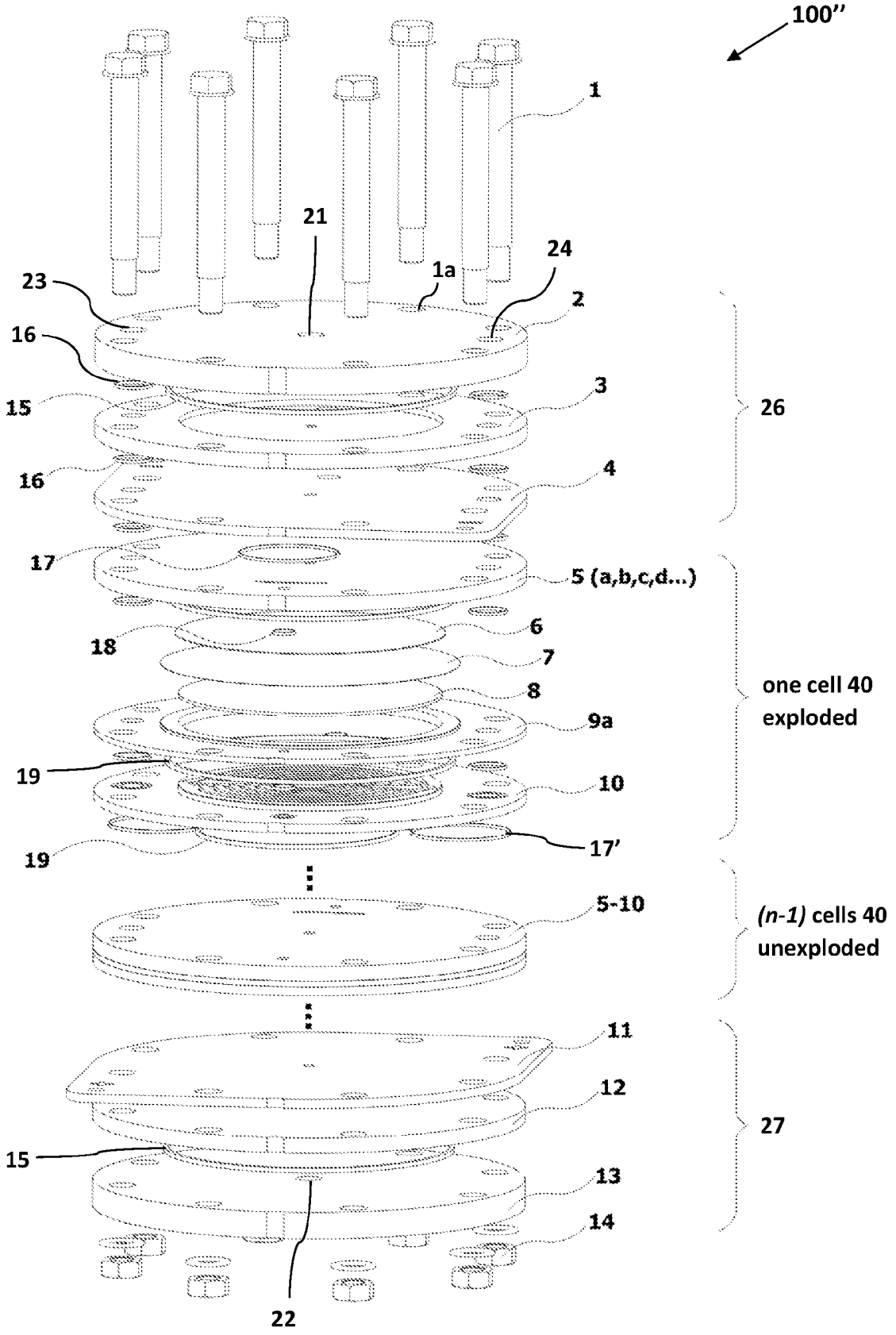
FIG. 4 is a partially exploded view of a multi-cell electrolyzer stack according to the invention comprising n cells with one electrolyzer cell exploded.

FIGS. 3 and 4 illustrate exemplary multi-cell electrolyzer stacks 100', 100" with more than one electrolyzer cell modules. In particular, FIGS. 3A and 3B are the upper and lower, respectively, perspective views of an electrolyzer stack 100' comprising three electrolyzer cells used to convert gaseous $CO_2$ to gaseous products at elevated pressures and with high conversion rates via electrolysis. FIG. 4 is a partially exploded view of a multi-cell electrolyzer stack 100" according to the invention which comprises n cells 40 (n is a positive integer) with one electrolyzer cell exploded in the series of cells 40. According to practical considerations, however, one chooses the number n to range from at least one to even ten or more; in particular, the number n of the applied cells is preferably between two and seven, more preferably between three and six, and most preferably it is three, or four, or five, or six in one electrolyzer stack 100".

As can be seen in FIGS. 3A, 3B and 4, the electrolyzer stacks 100', 100" are of modular construction, the components used to construct the stacks 100', 100" are provided in the form of plate-like elements of different function. The plate-like components may be of arbitrary planar shape; in the exemplary embodiments illustrated in FIGS. 3A, 3B and 4, the components are essentially circular in shape. Furthermore, to assist fast assembling and/or reassembling of said components into the stacks 100', 100", each of the plate-like components is provided with an assemblage assisting recess 52 formed in the peripheral edge thereof. The assemblage assisting recesses 52 thus clearly show how to combine the components into a stack properly; at the correct arrangement/orientation of the components, said recesses 52 are aligned.

Upon assembling said components into a stack, the obtained stack contains the individual electrolyzer cells side by side along a longitudinal direction. Here, and from now on, the term "longitudinal" refers to a direction that is essentially perpendicular to the surface planes of said plate-like components. Thus, as is shown in FIGS. 3A, 3B and 4, the plate-like components are provided with a plurality of through holes along said longitudinal direction. A part of said holes serves as bore holes 1*a* to receive screws 1 with shrink tubes and pads used to assemble said components into the stacks 100', 100" and then to connect said components in a sealed manner by means of screw-nuts 14 with pads screwed onto the screws 1 inserted into the respective bore holes 1*a*. The remaining part of the holes formed in said plate-like components, configured to be properly aligned with one another and sealed by means of specific channel sealing means (detailed below) that can be arranged around each of the holes and between the plate-like components, serves to form a longitudinal flow-through portion of the cathodic and anodic side transport channel structures within the stacks 100', 100". In particular, at the cathodic side, one of said holes serves as a gas inlet 21 to introduce gaseous $CO_2$ into the electrolyzer cells 40 assembled either in serial or parallel (or in mixed) configuration in terms of $CO_2$ supply and transport within the stack, while another two of said holes serve (i) as a fluid inlet 23 to introduce a liquid anolyte into the electrolyzer cells 40 assembled in serial/parallel configuration and (ii) as a fluid outlet 24 to discharge spoilt anolyte with gaseous anodic products (e.g. $O_2$) that form in the individual cells 40 in the anode-side electrolysis reaction(s). In turn, at the anodic side, one of said holes serves as a gas outlet 22 to discharge non-reacted $CO_2$ fed in in surplus with gaseous cathodic products that form in the cells 40 in the cathode-side electrolysis of $CO_2$.

Referring now to FIG. 4, the multi-cell $CO_2$ electrolyzer stack 100" according to the invention is used to decompose gaseous $CO_2$ by electrolysis and thus, depending on the applied catalysts and the anolyte, to generate various gaseous products. To this end, the stack 100" comprises a certain number n of electrolyzer cells 40 arranged adjacent to and in sealed fluid/gaseous communication with each other through the longitudinal portion of the cathodic and anodic side transport channel structures. Furthermore, said electrolyzer cells 40 are coupled electrically with one another and the electrical terminals of the stack 100", i.e. with the cathode-side and anode-side contact plates 4, 11 in series. Thus, the stack 100" contains a series of electrolyzer cells 40 consisting of interconnected intermediate cells sandwiched between a cathode-side end unit 26 and an anode-side end unit 27 arranged at opposite ends of said series along the longitudinal direction.

The cathode-side end unit 26 closes the series of electrolyzer cells 40 at the cathodic side of the stack 100". An inner surface of the cathode-side end unit 26 is in direct contact with the first cell 40 of said series, while an outer surface of the cathode-side end unit 26 is, in practice, exposed to the environment. The cathode-side end unit 26 is itself of a modular structure; it comprises a cathode-side contact plate 4 with the inner surface concerned, a cathode-side insulation 3 arranged on said cathode-side contact plate 4 and a cathode-side endplate 2 with said outer surface arranged on the cathode-side insulation 3. The cathode-side endplate 2 is provided with openings that are in gaseous/fluid communication with the cathodic and/or anodic transport channel structures, respectively, of the stack 100" through respective openings formed in the insulation 3 and the contact plate 4 in proper alignment with the openings concerned, that is, the gas inlet 21 for $CO_2$ supply, the fluid inlet 23 for anolyte supply and the fluid outlet 24 for spoilt anolyte (and anodic product) discharge. In the assembled state of the stack 100", the openings formed in the cathode-side end unit 26 in alignment with one another form continuous longitudinal sealed flow-channels, each of which opens into the respective opening of the first electrolyzer cell 40. Here, sealing is achieved by appropriately sized sealing elements, preferably in the form of O-rings 15, 16, 17 made of a corrosion resistant plastic material (e.g. Viton®), arranged between the endplate 2 and the insulation 3, the insulation 3 and the contact plate 4, as well as the contact plate 4 and said first cell around the respective openings. The cathode-side endplate 2 serves as a mechanical strengthening element and to enhance pressure-tightness of the stack 100" by means of the through screws 1. The cathode-side insulation 3 serves as an electrical insulation between the endplate 2 and the cathode-side contact plate 4. The cathode-side insulation 3 also accommodates a cathode-side pressure chamber that inhibits possible displacements of the inner components of the stack 100" towards the cathode-side endplate 2 when the stack 100" becomes pressurized upon starting its operation. Said pressure chamber is formed as a hollow cavity in the bulk of the cathode-side insulation 3 and extends over a given portion of the cathode-side endplate 2 when the stack 100" is assembled. In such a case, the cathode-side pressure chamber is sealed by an O-ring 15 arranged in a circular groove around said cavity in the cathode-side insulation 3 between the insulation 3 and the endplate 2. Furthermore, the cathode-side contact plate 4 serves as an electrical connection to an external electrical power source and simultaneously as a current distributing element that uniformly distributes the electric current received from said power source through the inner surface of the cathode-side end unit 26 over the outermost surface of the very first cell in the series of intermediate cells 40. The cathode-side contact plate 4 also helps with the feed-in of the gaseous $CO_2$ into the first electrolyzer cell 40 of the stack 100", and with the introduction and discharge of the liquid anolyte and the spoilt anolyte into and from, respectively, the first electrolyzer cell 40 of the stack 100".

The anode-side end unit 27 closes the series of electrolyzer cells 40 at the anodic side of the stack 100". An inner surface of the anode-side end unit 27 is in direct contact with the last, i.e. the n-th, cell 40 of said series, while an outer surface of the anode-side end unit 27 is, in practice, exposed to the environment. The anode-side end unit 27 is itself of a modular structure; it comprises an anode-side contact plate 11 with the inner surface concerned, an anode-side insulation 12 arranged on said anode-side contact plate 11 and an anode-side endplate 13 with said outer surface arranged on the anode-side insulation 12. The anode-side endplate 13 is provided with an opening that is in gaseous communication with the cathodic transport channel structure of the stack 100" through respective openings formed in the anode-side insulation 12 and the anode-side contact plate 11 in proper alignment with the opening at issue, i.e. the gas outlet 22 for $CO_2$ and cathode product discharge. In the assembled state of the stack 100", the openings formed in the anode-side end unit 27 in alignment with one another form a continuous longitudinal sealed flow-channel that opens into the corresponding opening of the last electrolyzer cell 40. Here, sealing is achieved by appropriately sized sealing elements, preferably in the form of O-rings, arranged between said last cell and the anode-side contact plate 11, the anode-side contact plate 11 and the anode-side insulation 12, as well as the anode-side insulation 12 and the anode-side endplate 13 around the openings; the O-rings concerned are similar/equivalent with the O-rings employed in the cathode-side end unit 26. Here, the anode-side contact plate 11 serves as an electrical connection to an external electrical power source and simultaneously as a current distributing element that uniformly distributes the electric current received from said power source through the inner surface of the anode-side end unit 27 over the outermost surface of the very last cell in the series of intermediate cells 40. The anode-side contact plate 11 also helps with the discharge of gaseous $CO_2$ mixed with the electrolysis product from the last electrolyzer cell 40 of the stack 100". The anode-side insulation 12 serves as an electrical insulation between the anode-side contact plate 11 and the anode-side endplate 13. The anode-side insulation 12 also accommodates an anode-side pressure chamber that inhibits possible displacements of the inner components of the stack 100" towards the anode-side endplate 13 when the stack 100" becomes pressurized upon starting its operation. Said pressure chamber is formed as a hollow cavity in the bulk of the anode-side insulation 12 and extends over a given portion of the anode-side endplate 13 when the stack 100" is assembled. In such a case, the anode-side pressure chamber is sealed by an O-ring 15 arranged in a circular groove around said cavity in the anode-side insulation 12 between the insulation 12 and the anode-side endplate 13. Furthermore, the anode-side endplate 13 serves as a mechanical strengthening element and to enhance pressure-tightness of the stack 100" by means of the screw-nuts 14 with pads screwed onto the screws 1 inserted through the entire structure of the stack 100" in the bore-holes 1*a* from the cathode-side endplate 2. In harmony with convention, the cathode-side contact plate 4 and the anode-side contact plate 11 are in electrical connections with the negative and positive, respectively, poles of the external power source.

Figure 5:
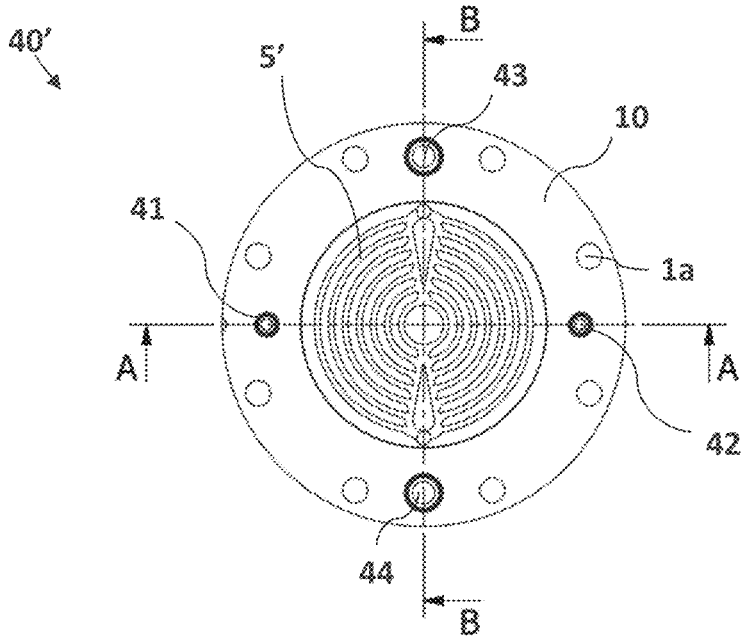
FIG. 5 is a bottom view of a preferred two-component bipolar plate assembly used as the first (anodic) component of an intermediate electrolyzer cell (cell i+1) of the stack, as well as the second (cathodic) part of an adjacent intermediate electrolyzer cell (cell i) of the stack (here, $0<i<n-1$, i, n are integer numbers)
Figure 5A:
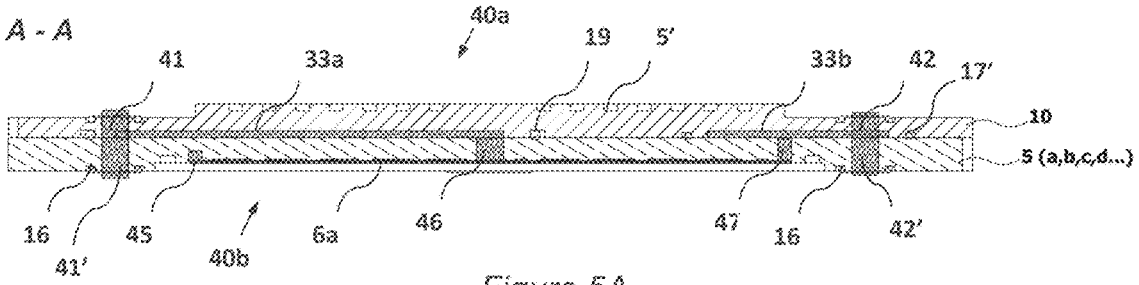
FIG. 5A is a cross-sectional view of the bipolar plate assembly illustrated in FIG. 5 along the A-A section.
Figure 5B:
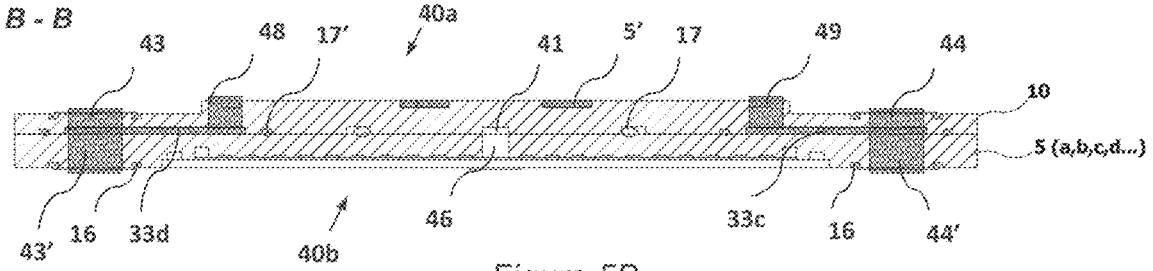
FIG. 5B is a cross-sectional view of the bipolar plate assembly illustrated in FIG. 5 along the B-B section.

Referring now to FIGS. 5, 5A and 5B, which illustrate the two-component bipolar plate assembly 40' in bottom view, in cross-sectional view taken along the A-A line and in cross-sectional view taken along the B-B line, respectively, the first component 40*a* of the assembly 40' (i.e. the anode current collector 10 in a single cell) and the second component 40*b* of the assembly 40' (i.e. the cathode current collector 5 (*a, b, c, d*) in a single cell) are provided on their opposite side surfaces with certain elements of the cathodic and anodic side transport channel structures. In particular, the first component 40*a* is provided with entry/exit ports for the cathode-side and anode-side systems of flow-channels within the cell 40'. Said ports are: a cell inlet gas transport channel 41 and a cell outlet gas transport channel 42 for gas supply and transport (i.e. $CO_2$, desired product) at the cathodic side in the bipolar plate assembly 40', as well as a cell anolyte inlet channel 48, a cell anolyte outlet channel 49, a cell anolyte transport channel 43, and a cell anolyte and anodic product transport channel 44 for fluid supply and transport (i.e. anolyte; spoilt anolyte with anodic product, e.g. gaseous $O_2$) at the anodic side in the bipolar plate assembly 40'. The first component 40*a* is further provided with an in-plane system of fluid flow-channels 5' of certain geometry on/in its side surface facing—when assembled into a stack—towards the cathode-side end unit. Said ports lead from said side surface to the opposite side surface of the first component 40*b* where each of said ports opens into a respective cavity which fully surrounds it, i.e. cavities 33*a*, 33*b*, 33*c*, 33*d*. Said cavities and ports provide the fluid communication with respective longitudinal fluid flow-channels 41', 42', 43', 44' formed in the second component 40*b*. Said second component 40*b* is also provided with a cell gas inlet channel 46 and a cell gas outlet channel 47 for gas supply and transport (i.e. $CO_2$, desired product) at the cathodic side in the bipolar plate assembly 40', as well as an in-plane system of gas flow-channels 5" of certain geometry (see FIG. 9). Said cavities are equipped with appropriate sealing members, in particular O-rings 16, 17, 17', 19 made of a corrosion resistant plastic material (e.g. Viton®) to seal the flow-channels when the stack is assembled and maintain pressure prevailing within the stack in operation.

The first and second components 40*a*, 40*b* of the assembly 40' are made of the same electrically conducting compound as the other parts of the stack, which are responsible for conducting electricity, e.g. titanium, stainless steel, different alloys and composite materials. The ports and the cavities are formed by machining, in particular CNC-milling.

Figure 10A:
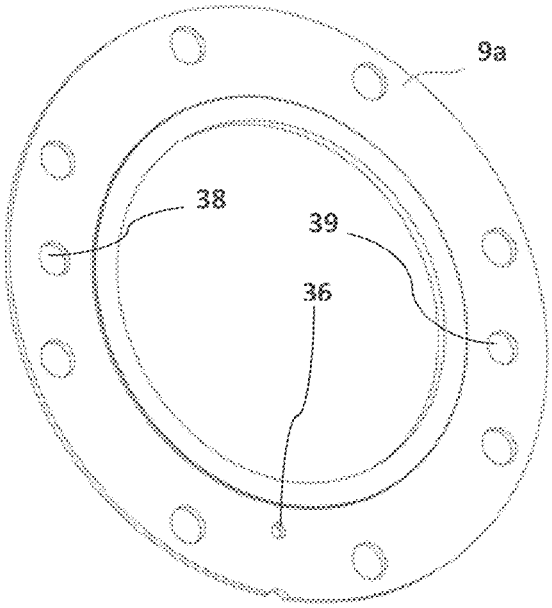
FIG. 10A illustrates a possible preferred embodiment of the anode-side spacer element used to accomplish a serial gas flow configuration between two adjacent cells/bipolar plate assemblies in a multi-cell electrolyzer stack upon assemblage.
Figure 10B:
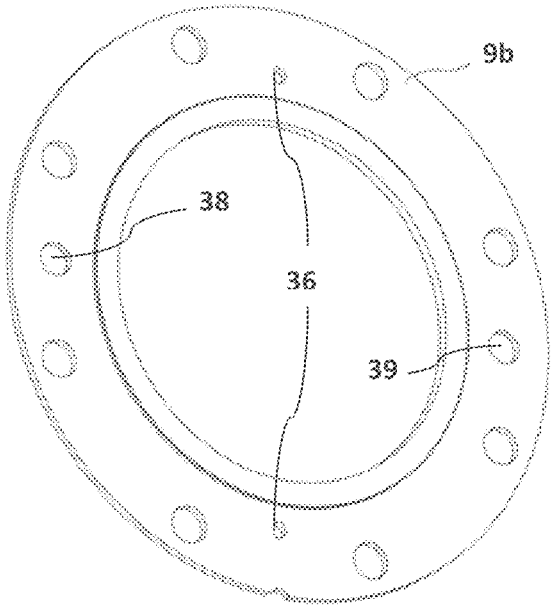
FIG. 10B illustrates a possible preferred embodiment of the anode-side spacer element used to accomplish a parallel gas flow configuration between two adjacent cells/bipolar plate assemblies in a multi-cell electrolyzer stack upon assemblage.

As is apparent from FIG. 4, after assembling the $CO_2$ electrolyzer stack 100" according to the invention, the cathode-side and the anode-side end units 26, 27 sandwich n pieces of practically identical intermediate electrolyzer cells 40, wherein the electrolyzer cells 40 are coupled to each other (i) in series in terms of the power (electric current) management of the stack 100", (ii) in parallel in terms of the anolyte supply and transport within the stack 100", and (iii) in series or parallel, or in a mixed way in terms of $CO_2$ supply and transport within the stack 100". Each cell 40 is constructed from the two-component bipolar membrane assemblies 40' (see FIGS. 5A and 5B). In particular, each cell 40 comprises the first (anodic) component 40*a* of the i-th bipolar membrane assembly 40', the second (cathodic) component 40*b* of the adjacent, i.e. (i−1)-th bipolar membrane assembly 40' (here, $1<i<n$, integer), a membrane electrode assembly discussed previously arranged between said first and second components 40*a*, 40*b*, and an anode-side spacer element 9*a*, 9*b* inserted between said first and second components 40*a*, 40*b* of the bipolar membrane assembly 40' in the peripheral region thereof. Feature (i) is a consequence of the electric contact between subsequent cells 40 in the stack 100". Feature (ii) is a consequence of the physical construction, i.e. the number of longitudinal channels provided in the anode-side spacer elements 9*a*, 9*b* for gas transport at the cathodic side and the orientation in which a certain spacer element 9*a*, 9*b* is actually arranged in the stack 100". In particular, as shown in FIG. 10A, a single longitudinal channel 36 is provided in the spacer elements 9*a* to be used when connecting two adjacent cells so as to form a serial gas flow-channel at the cathodic side of the stack 100"; the respective configuration of the cell is illustrated in exploded view in FIG. 12A. Moreover, as shown in FIG. 10B, two longitudinal channels 36 are provided in the spacer element 9*b* to be used when connecting two adjacent cells so as to form gas flow-channels extending in parallel at the cathodic side of the stack 100"; here the longitudinal channels 36 are formed at diametrically opposite locations of the spacer element 9*b*. The respective configuration of the cell is illustrated in exploded view in FIG. 12B.

Figure 8:
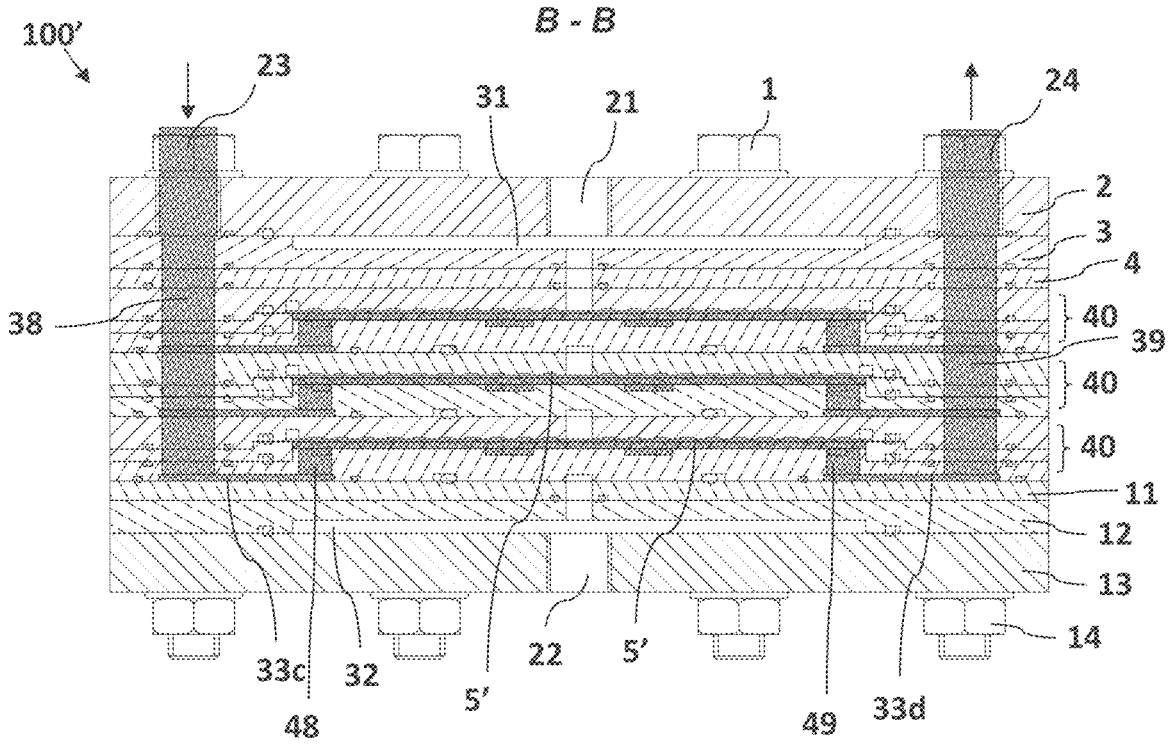
FIG. 8 is a cross-sectional view of the 3-cell stack along the B-B section shown in FIG. 3A in the serial/parallel configuration; here, the system of flow-channels and cavities shown in grey represents the way of fluid (i.e. anolyte) flow within the stack from the anolyte inlet to the anolyte and anodic product (in particular $O_2$ when water is used as anolyte) outlet.
Figure 6:
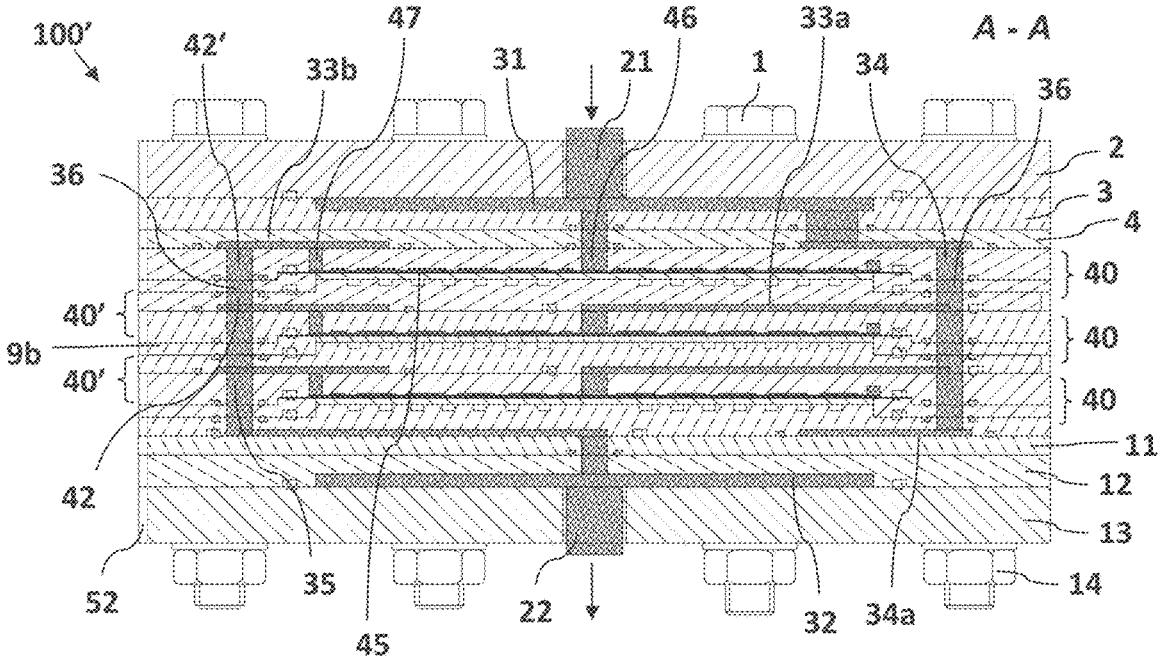
FIG. 6 is a cross-sectional view of a 3-cell stack along the A-A section shown in FIG. 3A assembled to accomplish a parallel flow configuration in terms of $CO_2$ supply of the stack; here, the system of flow-channels and cavities shown in grey represents the way of gas flow within the stack from the $CO_2$ inlet to the $CO_2$ and product outlet.
Figure 7:
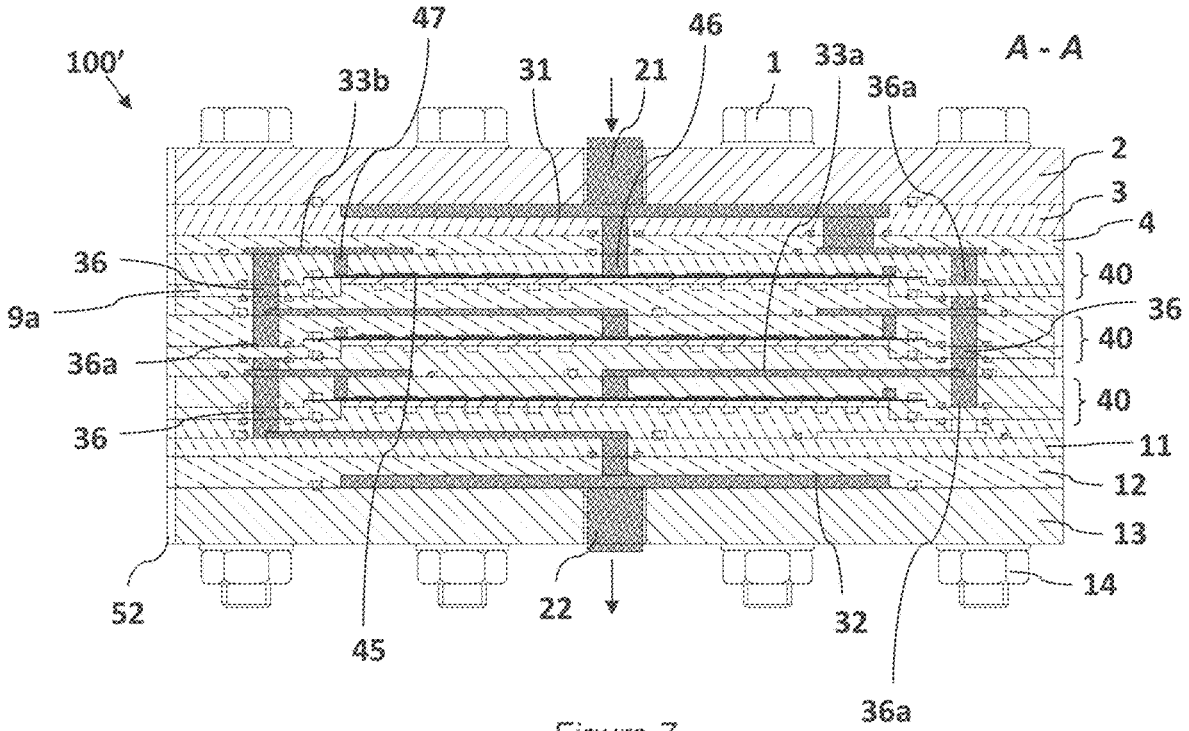
FIG. 7 is a cross-sectional view of the 3-cell stack along the A-A section shown in FIG. 3A assembled to accomplish a serial configuration in terms of $CO_2$ supply of the stack; here, the system of flow-channels and cavities shown in grey represents the way of gas flow within the stack from the $CO_2$ inlet to the $CO_2$ and product outlet.

In what follows, the cathode-side gas management and the anode-side fluid management is explained in more detail for a preferred embodiment of the multi-cell electrolyzer stack 100" comprising three individual cells 40 or bipolar plate assemblies 40'. In particular, FIG. 6 shows the 3-cell electrolyzer stack 100' in cross-sectional view taken along the A-A line illustrated in FIG. 3A with a stack's gas flow path shown in grey; here, the stack 100' is assembled in parallel configuration of the cell gas flow paths of the individual cells 40 in terms of $CO_2$ supply and transport within the stack 100'. Furthermore, FIG. 7 illustrates the 3-cell electrolyzer stack 100' in cross-sectional view taken along the A-A line shown in FIG. 3A with the stack's gas flow path shown again in grey; here, the stack 100' is assembled in serial configuration of the cell gas flow paths of the individual cells 40 in terms of $CO_2$ supply and transport within the stack 100'. Yet further, FIG. 8 shows the 3-cell electrolyzer stack 100' in cross-sectional view taken along the B-B line illustrated in FIG. 3A with the stack's fluid flow path shown in grey; here, the stack 100' is assembled in any of the serial and parallel configurations of the individual cells 40 in terms of $CO_2$ supply and transport within the stack 100', the cell fluid flow paths are combined to form a stack's fluid flow path in a parallel configuration in terms of anolyte supply and transport within the stack 100'.

FIG. 6 illustrates a continuous stack's gas flow path that extends from the gas inlet 21 to the gas outlet 22 through a cathode-side pressure chamber 31 formed within the cathode-side end unit, in particular in the cathode side insulation 3, then through bores formed in the cathode-side insulation 3 and the cathode-side contact plate 4 that open into a cell gas inlet 46 formed in the cathode current collector, then through said cell gas inlet 46 into grooves 45 of the flow pattern 5" (see FIG. 9) formed in the a surface of the cathode current collector facing to the cathode-side gas-diffusion layer and thus into the first electrolyzer cell 40 arranged in the series of cells 40 applied. The stack's gas flow path then extends further as an in-plane cell gas flow path of the first cell 40 formed between the cathode-side current collector and the cathode-side gas-diffusion layer being in partial contact with each other, and leaves the first cell 40 through a cell gas outlet 47 which is in gaseous communication with a sealed cavity 33*b*; said cavity 33*b* is formed in a surface of the anode current collector. The stack's gas flow path then extends from said cavity 33*b* through an outlet gas transport channel 35, then through bores formed in the anode-side contact plate 11 and the anode-side insulation 12 into an anode-side pressure chamber 32 formed within the anode-side end unit, in particular in the anode-side insulation 12, then from said anode-side pressure chamber 32 to the gas outlet 22. Here, the outlet gas transport channel 35 is formed by the cell outlet gas transport channels 42' (see FIG. 9) formed in the cathode current collector, the internal gas transport channel 36 of the anode spacer element 9*b* (see FIG. 10B) and the cell outlet gas transport channel 42 formed in the anode current collector (see e.g. FIG. 11A).

Furthermore, to supply $CO_2$ into the second and the any subsequent cells 40 too, the stack's flow path extends from the cathode-side pressure chamber 31 through an inlet gas transport channel 34 into sealed cavities 33*a* formed in said surface of the anode current collector of the individual cells 40, wherein each of the cavities 33*a* is connected with the cell gas inlet 46 of the cell 40. Thus, in operation, all the cells 40 are in gaseous communication with said inlet gas transport channel 34 which means a parallel gas transport configuration of the electrolyzer stack 100'. The inlet gas transport channel 34, which is formed by a cell inlet gas transport channel 41 formed in the cathode current collector, a further internal gas transport channel 36 of the anode spacer element 9*b* and a cell inlet gas channel 41, ends in an inlet gas transport channel end 34*a*, i.e. it is a dead furrow.

FIG. 7 illustrates a continuous stack's gas flow path that extends from the gas inlet 21 to the gas outlet 22. Here, when the multi-cell electrolyzer stack 100' is assembled, due to (i) the employment of an anode spacer member 9*a* that has only a single internal gas transport channel 36 (instead of two), and (ii) the fact that said anode spacer member 9*a* is arranged in the adjacent cells with an orientation that is rotated with just 180° about an axis perpendicular to the spacer element 9*a* at the centre thereof, the stack's flow path becomes a flow path of the cell flow paths connected in series as a consequence of segmentation of the inlet gas transport channel 34 and the outlet gas transport channel 35 (see FIG. 6).

FIG. 8 illustrates a continuous stack's fluid flow path that extends from the fluid inlet 23 to the fluid outlet 24 through a continuous inlet flow transport channel formed by through channel 43' in the cathode current collector, through channel 38 in the spacer element and through channel 43 in the anode current collector of the electrolyzer cells, then through sealed cavities 33*c* in flow communication with cell fluid inlets 48, then through the flow patterns 5' and through channels 49 into sealed cavities 33*d*, then from the cavities 33*d* in fluid communication with a continuous outlet flow transport channel formed by through channel 44 in the anode current collector, through channel 39 in the spacer element and through channel 44' in the cathode current collector of the electrolyzer cells.

In what follows, the constructional components of a single electrolyzer cell 40, e.g the one illustrated in FIG. 4 as the exploded cell, constructed from two-component bipolar plate assemblies 40' are explained in more detail with reference to FIGS. 9 to 11.

Figure 9:
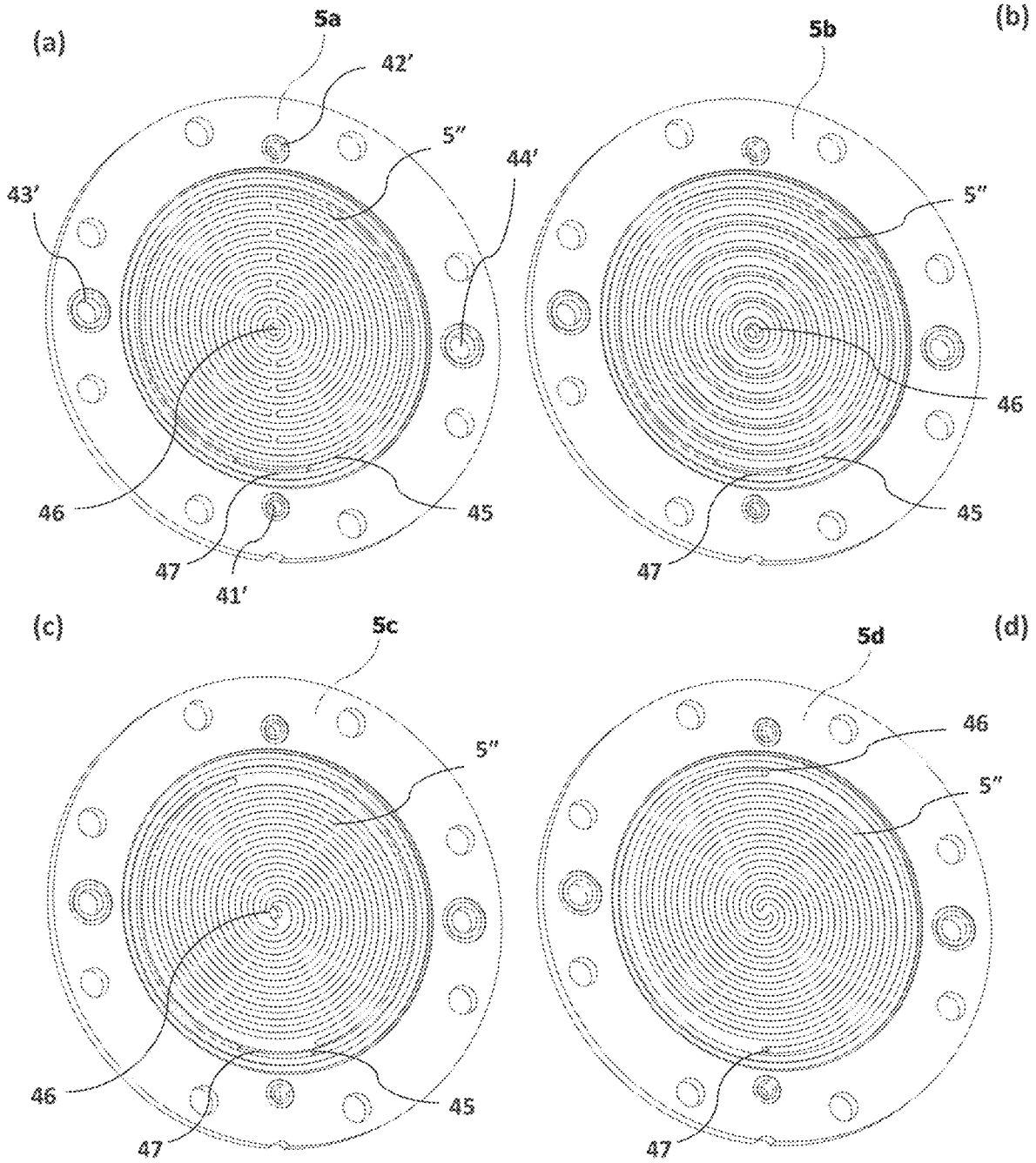
FIG. 9 illustrates various flow patterns formed in the surface of the cathode current collector used in the electrolyzer stack according to the present invention; here FIGS. 9(*a*) to (*c*) show some exemplary designs with $CO_2$ fed into the cell at the centre and $CO_2$ collection from the cell along an outer peripheral ring, while Figure (d) shows a further exemplary design with $CO_2$ fed into the cell on the perimeter of the cathode current collector and $CO_2$ collection from the cell also on the perimeter of the cathode current collector, but at a position located opposite relative to the point where $CO_2$ is introduced, after passing over a double spiral pattern.

In particular, FIG. 9 shows four possible embodiments of the cathode current collector 5*a*, 5*b*, 5*c*, 5*d* (forming the second component 40*b* of the two-component bipolar plate assemblies used), wherein each embodiment is provided with a certain in-plane flow-channel structure or flow pattern 5". The flow pattern 5" is a crucial part in achieving homogeneous $CO_2$ feed to the cathodic side of the cells and efficient product collection therefrom. Here, the $CO_2$ feed takes place through a cell gas inlet channel 46 extending longitudinally, while product collection is performed through a cell gas outlet channel 47 extending also along the longitudinal direction. Between said inlet and outlet channels 46 and 47, the gaseous $CO_2$ is transported and continuously involved the cathode electrolysis reaction and thus converts to the gaseous product within the grooves 45 of the continuous flow pattern 5" which is in contact with the membrane electrode assembly (not illustrated). As it can be seen in FIG. 9, in three exemplary flow designs, namely the flow designs of FIGS. 5(*a*) to 5(*c*) corresponding to a labyrinth-type flow pattern, an offset circles-type flow pattern and a radial double spiral-type flow pattern, respectively, the gaseous $CO_2$ is fed at the centre, i.e. the cell gas inlet channel 46 is located at the centre of the cathode current collector, and collected all along an outer ring, i.e. the cell gas outlet channel 47 is arranged in the peripheral portion of the cathode current collector. FIG. 5(*d*) illustrates such a further flow design, in the case of which the $CO_2$ is fed on the perimeter of the cathode current collector and collected at e.g. a diametrically opposite location of the cathode current collector after passing through a double-spiral pattern, that is, both the cell gas inlet and outlet channels 46, 47 are located in the peripheral region of the cathode current collector. Surprisingly, it was found that unlike in fuel cells, the best performing flow patterns were always those in which $CO_2$ was fed in the centre of the flow pattern.

It should be here noted that to use cathode current collectors 5*a*, 5*b*, 5*c*, 5*d* of different flow patterns 5" together with the same anode current collector 10 in a multilayered stack, or putting this another way, to use the second component 40*b* of various flow patterns 5" of the two-component bipolar plate 40' with a single type first component 40*a* (i.e. provided with a unique flow pattern 5') thereof, the inlet gas transport channel 41 is formed specifically. In particular, the shape of said inlet gas transport channel 41 is circular at the side of the second component 40*b* with the flow pattern 5", while it has a narrow elongated shape at the opposite side of the second component 40*b* to cover the cell gas inlet channel 46 independent of the fact whether it is formed at the centre or in a peripheral region of the second component 40*b*.

FIGS. 10A and 10B show possible embodiments of the anode-side spacer elements 9*a*, 9*b* to be arranged between the cathode current collector and the anode current collector in every electrolyzer cell 40 of the multi-cell electrolyzer stack 100', 100" to accomplish either the serial or the parallel, respectively, cathode-side gas flow-channel configuration. The two kinds of anode-side spacer element 9*a*, 9*b* are practically identical, but the number of internal gas transport channels 36 extending in the longitudinal direction. With this unique choice of design, the anode-side spacer elements are such spacer elements that are configured to act as means for selectively choose the way two adjacent cell flow paths connect to one another in the gas flow path of the electrolyzer stack. The anode-side spacer elements 9*a*, 9*b* are made of electrical insulators, preferably plastics or Teflon. Thus, said anode-side spacer elements 9*a*, 9*b* can be simply and cheaply fabricated, even on the industrial scale and in an automated manner.

Figure 11A:
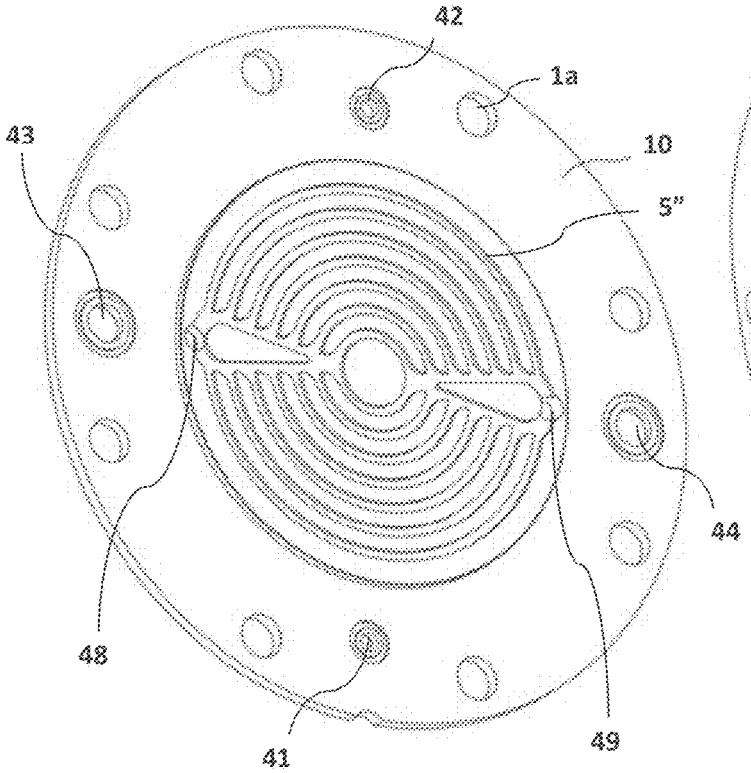
FIGS. 11A and 11B show a possible preferred embodiment of the anode current collector, that is, the anodic part of the bipolar plate assembly in FIG. 5, in top and bottom views, respectively, formed with a flow pattern in one of its side surfaces, highlighting the cavities formed for O-ring sealings.
Figure 11B:
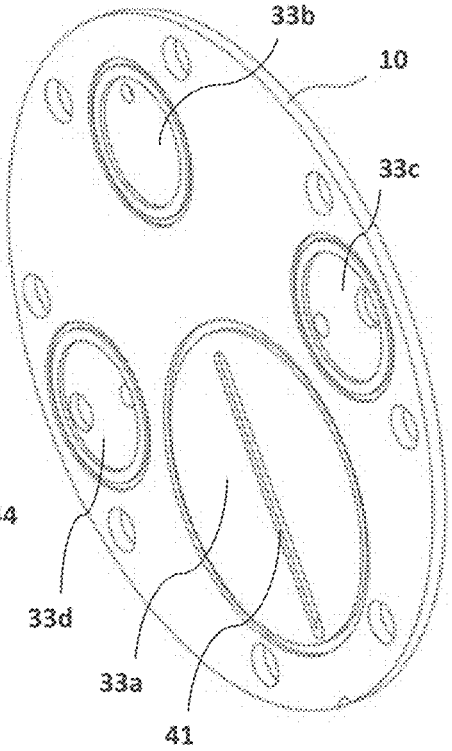

FIG. 11 presents the anode current collector 10 (which forms the first component 40*a* of the two-component bipolar plate assemblies) used in the $CO_2$ electrolyzer stacks according to the invention, FIG. 11A is a top view, while FIG. 11B is a bottom view of the anode current collector 10, highlighting the cavities 33*a*, 33*b*, 33*c*, 33*d* provided for establishing a sealed gaseous/fluid communication for the gaseous/fluid management of the stack, as well as to accommodate the required sealing elements, i.e. the various O-rings.

Figure 12A:
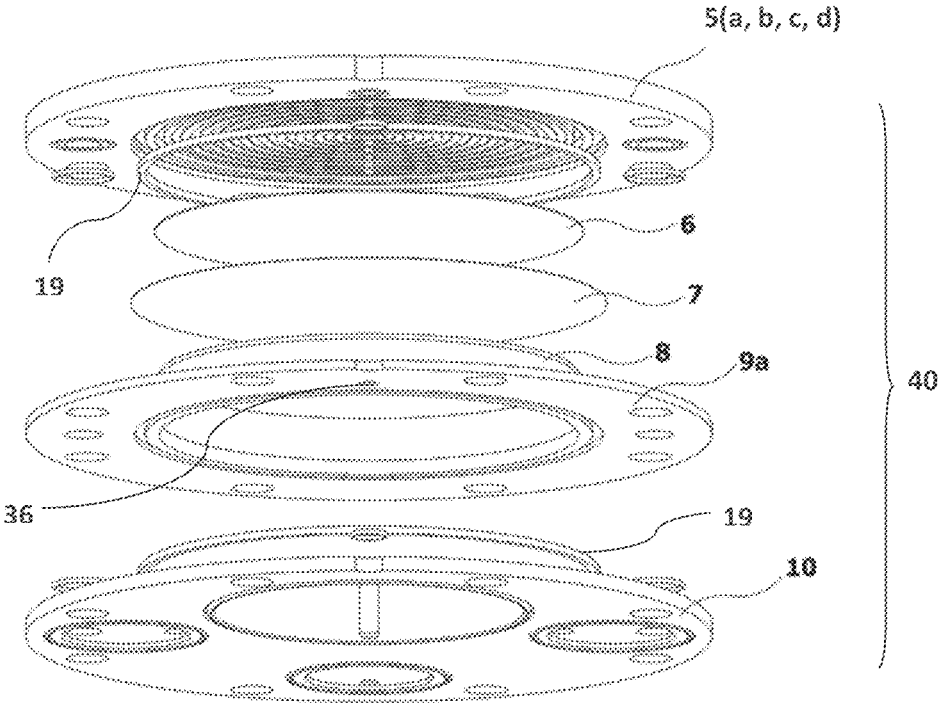
FIGS. 12A and 12B are exploded views of a single cell in a multilayered electrolyzer stack assembled with serial or parallel gas flow configurations, respectively.
Figure 12B:
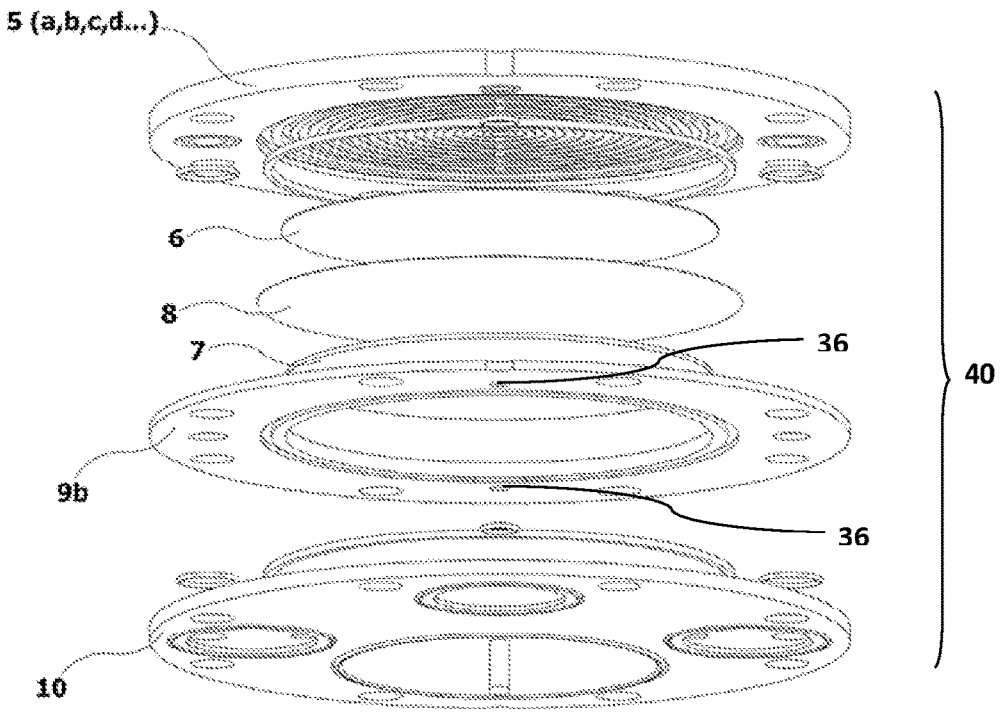

Finally, FIGS. 12A and 12B illustrate a single cell 40 of a multi-cell electrolyzer stack assembled with serial and parallel cathode-side gas flow configurations, respectively, in exploded views. FIGS. 12A and 12B also show the advantage of the modular construction applied. In particular, by replacing the anode spacer element 9*a* having only a single internal gas transport channel 36 with an anode spacer element 9*b* comprising two internal gas transport channels 36, the flow configuration of the cell 40 concerned is simply modified from the serial one to the parallel one, and vice versa. That is, by simply disassembling the electrolyzer stack to cells and then any of the cells to components, replacing the anode spacer element(s) with anode spacer element(s) which is/are required for the desired cathode-side gas flow configuration, then reassembling each cells from the components and then the stack from the cells, a multi-cell electrolyzer stack of the desired gas flow management is obtained. Hence, the multilayered electrolyzer stack according to the invention can be simply and rapidly matched with the operational needs, and practically on the spot.

In what follows, the invention and its advantages are further discussed on the basis of experimental measurements performed specifically on $CO_2$ electrolyzer stacks constructed with one cell or three cells, which are connected in the latter case in series/parallel.

As it was already discussed, the $CO_2$ electrolyzer stack according to the present invention is of a construction of at least one, preferably more than one cells, i.e. its core which performs the electrolysis of $CO_2$ is built up of individual electrolyzer cells connected electrically in series and in terms of the stack's gas management either in serial or in parallel configuration; the number of cells used to construct the stack is up to even ten or more, it ranges preferably from two to seven, more preferably from three to six, and most preferably it is three, or four, or five, or six.

Example 1—Operation

In this example, some operational characteristics of a 3-cell stack assembled in serial configuration and then in parallel configuration (in terms of the cathode-side gas management) are compared with those of a 1-cell stack (i.e. a single cell) in brief.

Figure 13:
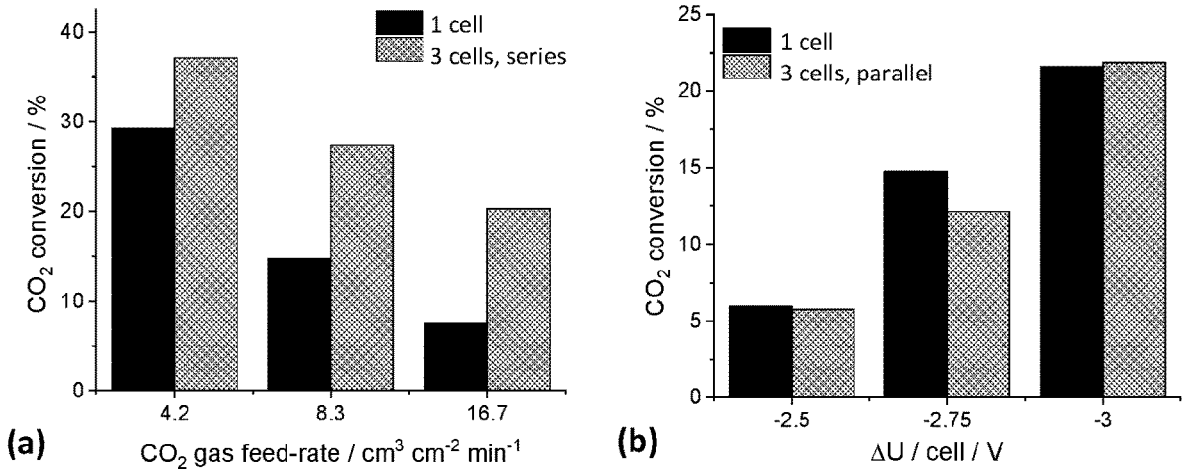
FIG. 13 illustrates the effects of the increase in the number of individual electrolyzer cells applied in the electrolyzer stack according to the present invention assembled in either a serial or a parallel gas flow configuration; in particular, in plot (a), the $CO_2$ conversions during electrolysis at $\Delta U=-2.75$ V/cell achievable with a 1-cell and a 3-cell serial connected electrolyzer at different $CO_2$ feed rates are plotted, and in plot (b), the $CO_2$ conversion during electrolysis at different cell voltages achievable with an electrolyzer stack consisting of one cell or three cells, connected in parallel (with identical cell normalized gas feed), are shown.

FIG. 13 illustrates the effects of the increase in the number of individual electrolyzer cells used in a possible embodiment of the stack according to the invention assembled in either a serial or a parallel gas flow configuration. In particular, in plot (a), the $CO_2$ conversions during electrolysis at $\Delta U=-2.75$ V/cell achieved for a 1-cell and a 3-cell serial connected stack at different $CO_2$ feed rates are plotted. In plot (b), the $CO_2$ conversion during electrolysis at different stack voltages achieved for a stack consisting of one cell or three cells, connected in parallel (with identical cell normalized gas feed), are shown. The series of measurements were performed feeding T=50° C. 1M KOH anolyte to the anode (at a feed rate of 1.5 $dm^3$ $min^{-1}$). As for the cathode catalyst layer, 3 mg $cm^{-2}$ Ag was immobilized on Sigracet39BC carbon paper by spray coating. As for the anode catalyst, 1 mg $cm^{-2}$ Ir black was immobilized on a porous titanium frit. Both catalyst layers contained 15 wt % Sustanion ionomer. The cathode compartment was purged with humidified (in room temperature deionized water) $CO_2$. Furthermore, the $CO_2$ flow rate was set to 8.3 $cm^3$ $cm^{-2}$ $min^{-1}$ for the measurements shown in (b).

As is clear from plot (a), when three electrolyzer cells are coupled in series (compared to the 1-cell stack under the same conditions):

- the $CO_2$ conversion gets improved;
- this effect is more pronounced at higher flow rates; and
- a conversion of about 40% is achieved.

As is clear from plot (b), when three electrolyzer cells are coupled in parallel (compared to the 1-cell stack under the same conditions):

- it is possible to increase the number of cells without changing the operational features;
- inside the stack, the $CO_2$ stream is divided uniformly; and
- the conversion and the CO partial currents are similar in the 3-cell configuration, which is a clear proof of the scalability of the process.

Figure 14:
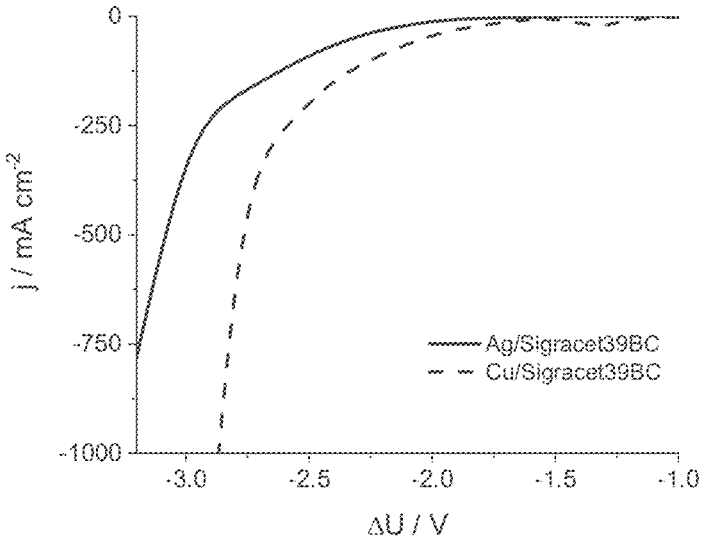
FIG. 14 shows current density versus operational cell-voltage of a 3-cell $CO_2$ electrolyzer stack according to the invention used for syngas ($H_2$/CO mixture on Ag catalyst) or hydrocarbon ($CH_4$ and $C_2H_4$ on Cu catalyst) formation, recorded by linear sweep voltammetry (LSV) at v=10 mV $s^{-1}$ sweep rate with different catalyst containing cathode gas diffusion electrodes (GDEs)

FIG. 14 illustrates the current density versus the operational cell-voltage of a 3-cell $CO_2$ electrolyzer stack according to the invention used for syngas ($H_2$/CO mixture on Ag catalyst) or hydrocarbon ($CH_4$ and $C_2H_4$ on Cu catalyst) formation. The curves were recorded by linear sweep voltammetry (LSV) at v=10 mV $s^{-1}$ sweep rate with different catalyst containing cathode gas diffusion electrodes (GDEs). The series of measurements were performed feeding T=50° C. 1M KOH anolyte continuously to the anode compartment (at a feed rate of ~9 $cm^3$ $cm^{-2}$ $min^{-1}$), while the cathode compartment was purged with humidified (in room temperature deionized water) $CO_2$ at a flow rate of u=2.5 $cm^3$ $cm^{-2}$ $min^{-1}$. As for the cathode catalyst layer, 1 mg $cm^{-2}$ Ag was immobilized on Sigracet39BC carbon paper by spray coating. The Cu containing GDE was formed by electrodeposition. As for the anode catalyst layer, 1 mg $cm^{-2}$ Ir black was immobilized on a porous titanium frit. Both catalyst layers contained 15 wt % Sustanion ionomer. Moreover, the stack was mounted with a spacer element of 300 μm in thickness.

Electrochemistry of the cells proves the low voltage need. Due to the excellent electrical coupling among the various components of the stack, which is enhanced under pressure, the operational voltage of the stack is rather low (2.5 to 3.0 V). This translates to good energy efficiencies (40-50%). Syngas ($H_2$/CO mixture) formation was demonstrated on Ag/C catalyst, while ethylene production was demonstrated on a Cu/C catalyst.

Figure 15:
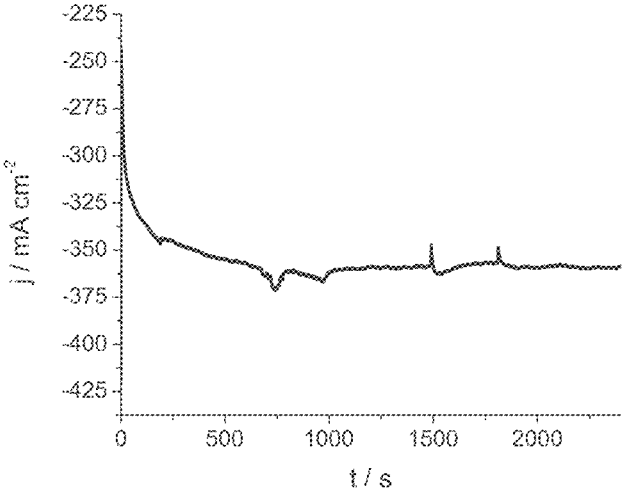
FIG. 15 is a chronoamperometric curve taken at $\Delta U=-3$ V/cell for a 3-cell $CO_2$ electrolyzer stack according to the present invention, using a 1 mg $cm^{-2}$ Ag containing cathode GDE, immobilized on Sigracet39BC carbon paper by spray coating.

FIG. 15 demonstrates the stable operation of the electrolyzer stack. The shown chronoamperometric curve was taken at $\Delta U=-3$ V/cell for a 3-cell $CO_2$ electrolyzer stack according to the invention, using a 1 mg $cm^{-2}$ Ag catalyst containing cathode GDE, immobilized on Sigracet39BC carbon paper by spray coating. As for the anode, 1 mg $cm^{-2}$ Ir black was immobilized on a porous titanium frit. Both catalyst layers contained 15 wt % Sustanion ionomer. The stack was mounted with a spacer element of 270 μm in thickness. The measurement was performed feeding T=50° C. 1M KOH anolyte continuously to the anode compartment (at a feed rate of ~9 $cm^3$ $cm^{-2}$ $min^{-1}$), while the cathode compartment was purged with humidified (in room temperature deionized water) $CO_2$ at a flow rate of u=2.5 $cm^3$ $cm^{-2}$ $min^{-1}$.

Figure 16:
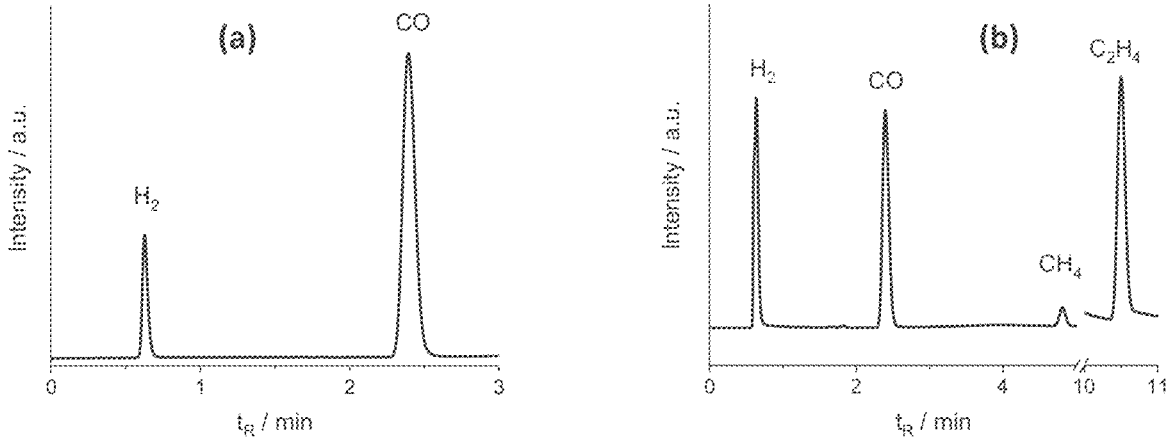
FIG. 16 presents gas chromatograms recorded during a chronoamperometric measurement at $\Delta U=-2.75$ V/cell performed with a 3-cell $CO_2$ electrolyzer stack according to the present invention, using Ag catalyst [plot (a)] or Cu catalysts [plot (b)]

FIG. 16 presents the formation of different gaseous $CO_2$-reduction products, generated using the electrolyzer stack with different catalysts. Gas chromatograms recorded during a chronoamperometric measurement at $\Delta U=-2.75$ V/cell performed with a 3-cell $CO_2$ electrolyzer stack according to the present invention are shown, using a spray coated, 3 mg $cm^{-2}$ Ag catalyst containing GDE [plot (a)] and Cu catalyst containing GDE, formed by electrodeposition of copper nanocubes on Sigracet39BC carbon paper [plot (b)]. As for the anode, 1 mg $cm^{-2}$ Ir black was immobilized on a porous titanium frit. The Ag containing GDE and the anode catalyst layer contained 15 wt % Sustanion ionomer. The stack was mounted with a spacer element of 270 μm in thickness. The measurement was performed feeding T=50° C. 1M KOH anolyte continuously to the anode compartment (at a feed rate of ~9 $cm^3$ $cm^{-2}$ $min^{-1}$), while the cathode compartment was purged with humidified (in room temperature deionized water) $CO_2$ at a flow rate of u=2.5 $cm^3$ $cm^{-2}$ $min^{-1}$.

Example 2—Voltage Dependent Product Distribution

The present example proves that the composition of the product syngas ($H_2$/CO ratio) can be simply tuned by the voltage of the stack. The higher the stack voltage, the more $H_2$ is generated.

Figure 17:
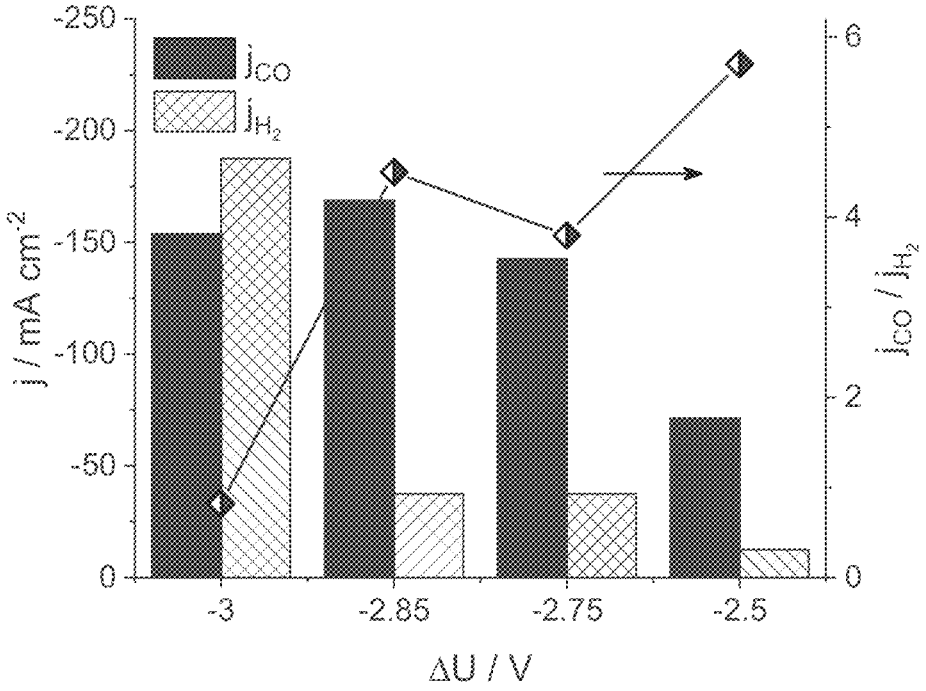
FIG. 17 shows partial current densities for CO and $H_2$ formation (ordinates to the left), as well as the ratio of the partial current densities (ordinates to the right) at different stack voltages (obtained by chronoamperometric and gas chromatography measurements)

FIG. 17 shows partial current densities for CO and $H_2$ formation (ordinates to the left), as well as the ratio of the partial current densities (ordinates to the right) at different stack voltages (obtained by chronoamperometric and gas chromatography measurements), using a 3 mg $cm^{-2}$ Ag containing cathode GDE, immobilized on Sigracet39BC carbon paper by spray coating. As for the anode, 1 mg $cm^{-2}$ Ir black was immobilized on a porous titanium frit. Both catalyst layers contained 15 wt % Sustanion ionomer. The stack was mounted with a spacer element of 300 μm in thickness. The measurements were performed feeding T=50° C. 1M KOH anolyte continuously to the anode compartment (at a feed rate of ~9 $cm^3$ $cm^{-2}$ $min^{-1}$), while the cathode compartment was purged with humidified (in room temperature deionized water) $CO_2$ at a flow rate of u=2.5 $cm^3$ $cm^{-2}$ $min^{-1}$.

Example 3—Effect of Catalyst Loading

The present example proves that the rate of carbon dioxide reduction strongly depends on the immobilized cathode catalyst amount. The partial current density for CO formation reaches a maximum at an intermediate catalyst loading.

Figure 18:
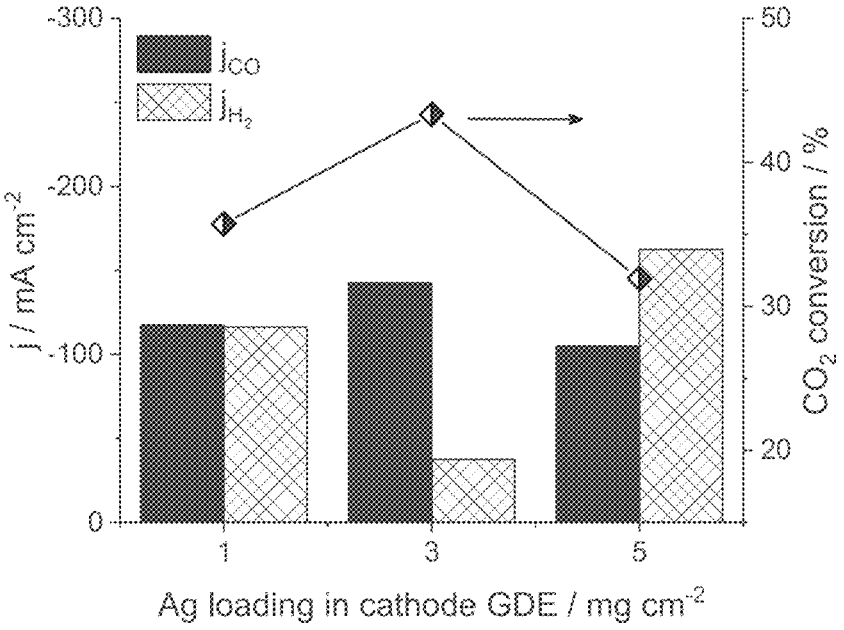
FIG. 18 partial current densities for $H_2$ and CO formation (ordinates to the left) and $CO_2$ conversion (ordinates to the right) during electrolysis at $\Delta U=-2.75$ V as a function of the Ag catalyst amount in the cathode GDE.

FIG. 18 shows partial current densities for $H_2$ and CO formation (ordinates to the left) and $CO_2$ conversion (ordinates to the right) during electrolysis at ΔU=−2.75 V as a function of the Ag catalyst amount in the cathode GDE. The Ag cathode catalyst layer was immobilized on Sigracet39BC carbon paper by spray coating. As for the anode, 1 mg $cm^{-2}$ Ir black was immobilized on a porous titanium frit. Both catalyst layers contained 15 wt % Sustanion ionomer. The measurements were performed feeding T=50° C. 1M KOH anolyte continuously to the anode compartment (at a feed rate of ~9 $cm^3$ $cm^{-2}$ $min^{-1}$), while the cathode compartment was purged with humidified (in room temperature deionized water) $CO_2$ at a flow rate of u=2.5 $cm^3$ $cm^{-2}$ $min^{-1}$.

Example 4—Effect of Cathode Spacing (GDL Compression)

The present example presents an additional benefit of the stack design according to the invention. By just changing one plastic element, the compression of the gas diffusion layer (GDL) can be varied. Notably, both the product distribution and the conversion are affected by this parameter. Importantly, if different GDLs have to be used, the stack can be quickly and easily tailored to it (unlike for the fuelcell like setups, where the gas-sealing and compression of the GDL is achieved by using a gasket of a given thickness, which has to be carefully tailored to the GDE in hand).

Figure 19:
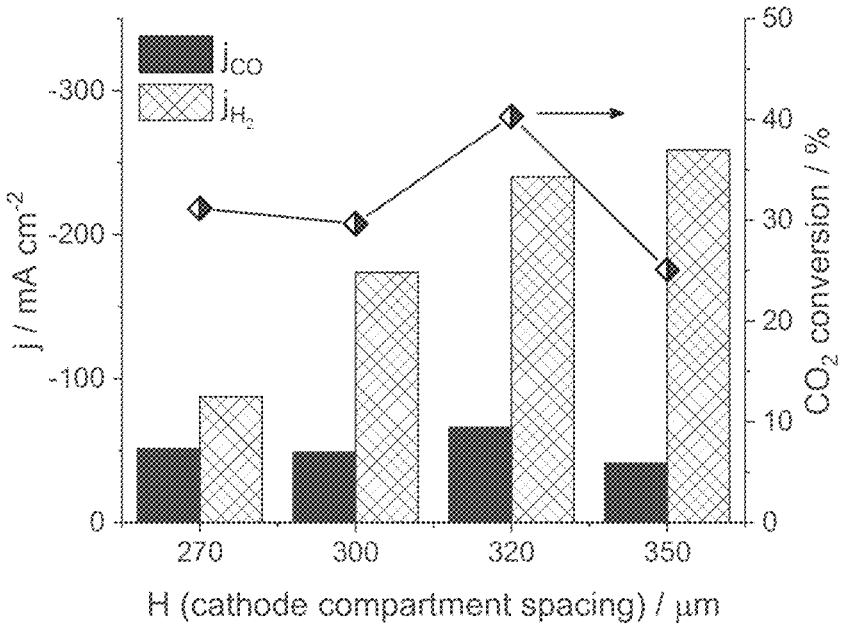
FIG. 19 shows partial current densities for $H_2$ and CO formation (ordinates to the left) and $CO_2$ conversion (ordinates to the right) during electrolysis at $\Delta U=-2.75$ V as a function of the applied cathode spacing.

FIG. 19 shows partial current densities for $H_2$ and CO formation (ordinates to the left) and $CO_2$ conversion (ordinates to the right) during electrolysis at ΔU=−2.75 V as a function of the applied cathode spacing. As for the cathode, 1 mg $cm^{-2}$ Ag cathode catalyst layer was immobilized on Sigracet39BC carbon paper by spray coating. As for the anode, 1 mg $cm^{-2}$ Ir black was immobilized on a porous titanium frit. Both catalyst layers contained 15 wt % Sustanion ionomer. The measurements were performed feeding T=50° C. 1M KOH anolyte continuously to the anode compartment (at a feed rate of ~9 $cm^3$ $cm^{-2}$ $min^{-1}$), while the cathode compartment was purged with humidified (in room temperature deionized water) $CO_2$ at a flow rate of u=1.25 $cm^3$ $cm^{-2}$ $min^{-1}$.

Example 5—Effect of Flow Pattern Applied in the Cathode Current Collector

The present example clearly shows that the flow pattern design (see FIG. 9) has a prominent effect on the residence time of the $CO_2$ gas in the electrolyzer stack according to the invention, and hence on the stack performance. Here the effect of groove depth M (see FIG. 2B) is presented for the flow pattern of FIG. 9(*a*). According to this example, there is an optimal groove-depth, and thus residence time, which ensures high conversion rates.

Figure 20:
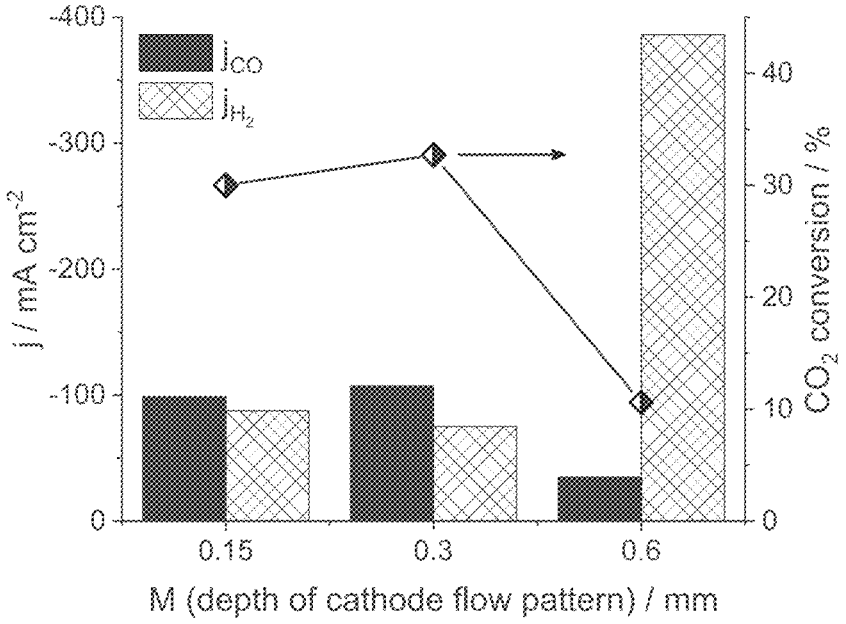
FIG. 20 presents partial current densities for $H_2$ and CO formation (ordinates to the left) and $CO_2$ conversion (ordinates to the right) during electrolysis at $\Delta U=-2.75$ V as a function of the depth of the flow-pattern applied in the cathodic side of the electrolyzer stack according to the invention.

FIG. 20 shows partial current densities for $H_2$ and CO formation (ordinates to the left) and $CO_2$ conversion (ordinates to the right) during electrolysis at ΔU=−2.75 V as a function of the depth M of the grooves of the flow-pattern applied in the cathodic side of the electrolyzer stack according to the invention. As for the cathode, 3 mg $cm^{-2}$ Ag cathode catalyst layer was immobilized on Sigracet39BC carbon paper by spray coating. As for the anode, 1 mg $cm^{-2}$ Ir black was immobilized on a porous titanium frit. Both catalyst layers contained 15 wt % Sustanion ionomer. The measurements were performed feeding T=50° C. 1M KOH anolyte continuously to the anode compartment (at a feed rate of ~9 $cm^3$ $cm^{-2}$ $min^{-1}$), while the cathode compartment was purged with humidified (in room temperature deionized water) $CO_2$ at a flow rate of u=2.5 $cm^3$ $cm^{-2}$ $min^{-1}$.

Example 6—Effect of Carbon Dioxide Flow Rate in the Electrolyzer Stack

The present example is to prove that an increasing $CO_2$ flow rate increases the conversion rate (current density) of the electrolyzer stack according to the invention. At the same time, the relative ratio of the converted $CO_2$ to the feed-rate decreases (thus an optimal value for the $CO_2$ flow rate has to be found and used).

Figure 21:
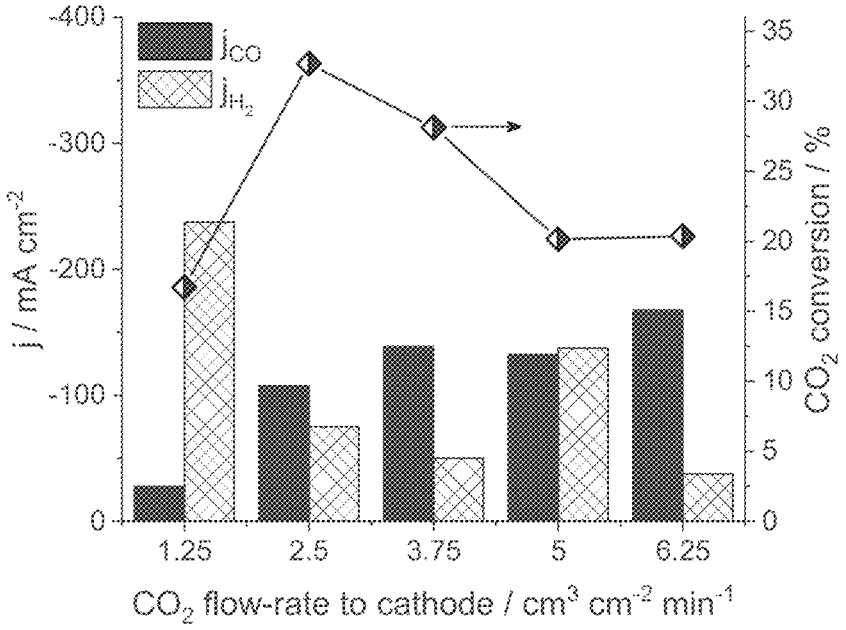
FIG. 21 illustrates partial current densities for $H_2$ and CO formation (ordinates to the left) and $CO_2$ conversion (ordinates to the right) during electrolysis at $\Delta U=-2.75$ V as a function of carbon-dioxide flow rate (normalized with the surface area) in the cathode compartment of the electrolyzer stack according to the invention.

FIG. 21 illustrates partial current densities for $H_2$ and CO formation (ordinates to the left) and $CO_2$ conversion (ordinates to the right) during electrolysis at ΔU=−2.75 V as a function of carbon-dioxide flow rate (normalized with the surface area) in the cathode compartment of the electrolyzer stack according to the invention. Again, as for the cathode, 3 mg $cm^{-2}$ Ag cathode catalyst layer was immobilized on Sigracet39BC carbon paper by spray coating. As for the anode, 1 mg $cm^{-2}$ Ir black was immobilized on a porous titanium frit. Both catalyst layers contained 15 wt % Sustanion ionomer. The measurements were performed feeding T=50° C. 1M KOH anolyte continuously to the anode compartment (at a feed rate of ~9 $cm^3$ $cm^{-2}$ $min^{-1}$).

Example 7—Effect of Anolyte (Stack) Temperature

The present example is to prove that high reaction rate and selectivity can be achieved at elevated temperatures, which can easily be regulated by the anolyte temperature. Importantly, the components of the electrolyzer stack are designed to withstand exposure to hot (alkaline) solutions, as exemplified in this case.

Figure 22:
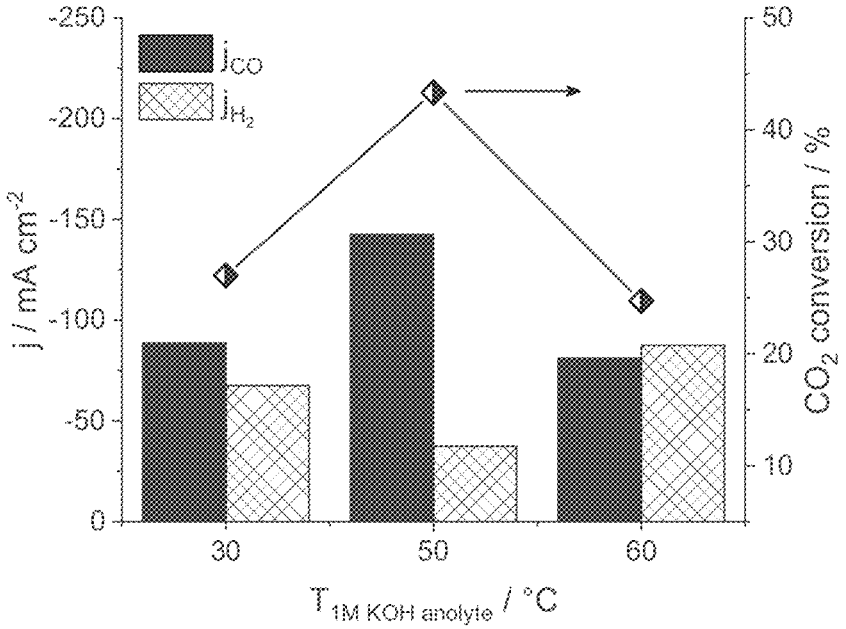
FIG. 22 shows partial current densities for $H_2$ and CO formation (ordinates to the left) and $CO_2$ conversion (ordinates to the right) during electrolysis at $\Delta U=-2.75$ V as a function of the anolyte (1M KOH) temperature (at ~9 $cm^3$ $cm^{-2}$ $min^{-1}$ feed rate) taking place in the electrolyzer stack according to the invention.

FIG. 22 shows partial current densities for $H_2$ and CO formation (ordinates to the left) and $CO_2$ conversion (ordinates to the right) during electrolysis at ΔU=−2.75 V as a function of the anolyte (1M KOH) temperature (at a feed rate of ~9 $cm^3$ $cm^{-2}$ $min^{-1}$) taking place in the electrolyzer stack according to the invention. The cathode compartment was purged with humidified (in room temperature deionized water) $CO_2$ at a flow rate of u=2.5 $cm^3$ $cm^{-2}$ $min^{-1}$. Again, as for the cathode, 3 mg $cm^{-2}$ Ag cathode catalyst layer was immobilized on Sigracet39BC carbon paper by spray coating. As for the anode, 1 mg $cm^{-2}$ Ir black was immobilized on a porous titanium frit. Both catalyst layers contained 15 wt % Sustanion ionomer.

Example 8—Effect of Pressure in the Electrolyzer Stack

The present example is to prove that at lower stack voltages the $CO_2$ reduction, while at larger stack voltages the water reduction is the dominant cathode process. The cross-over between the two processes is shifted to larger current densities by increasing the $CO_2$ pressure, allowing $CO_2$ electroreduction to proceed at higher rates. The slope of the LSV curve at lower stack voltages increases gradually with the $CO_2$ pressure. Hence, lower stack voltages are required to achieve the same current density under pressurized operation of the electrolyzer stack. This is further highlighted by tracing the LSV curves—recorded at different $CO_2$ pressures—at given stack voltages.

Figure 23:
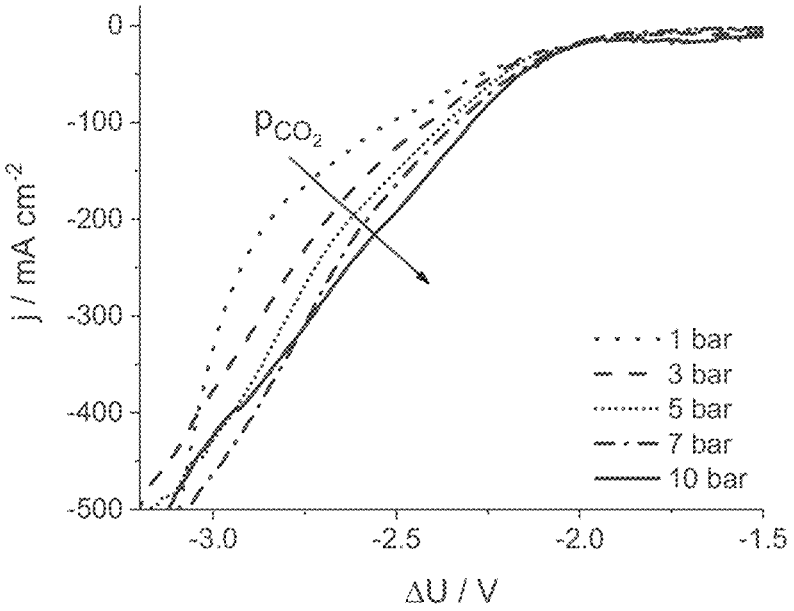
FIG. 23 presents LSV curves recorded at v=10 mV $s^{-1}$ sweep rate under various differential $CO_2$ pressures during electrolysis performed in the electrolyzer stack according to the invention.

FIG. 23 presents LSV curves recorded at v=10 mV $s^{-1}$ sweep rate under various differential $CO_2$ pressures ranging from 1 bar to 10 bar during electrolysis performed in the electrolyzer stack according to the invention. Again, as for the cathode, 3 mg $cm^{-2}$ Ag cathode catalyst layer was immobilized on Sigracet39BC carbon paper by spray coating. As for the anode, 1 mg $cm^{-2}$ Ir black was immobilized on a porous titanium fit. The measurements were performed feeding T=50° C. 1M KOH anolyte continuously to the anode compartment (at a feed rate of ~9 $cm^3$ $cm^{-2}$ $min^{-1}$), while the cathode compartment was purged with humidified (in room temperature deionized water) $CO_2$ at a flow rate of u=12.5 $cm^3$ $cm^{-2}$ $min^{-1}$.

Figure 24:
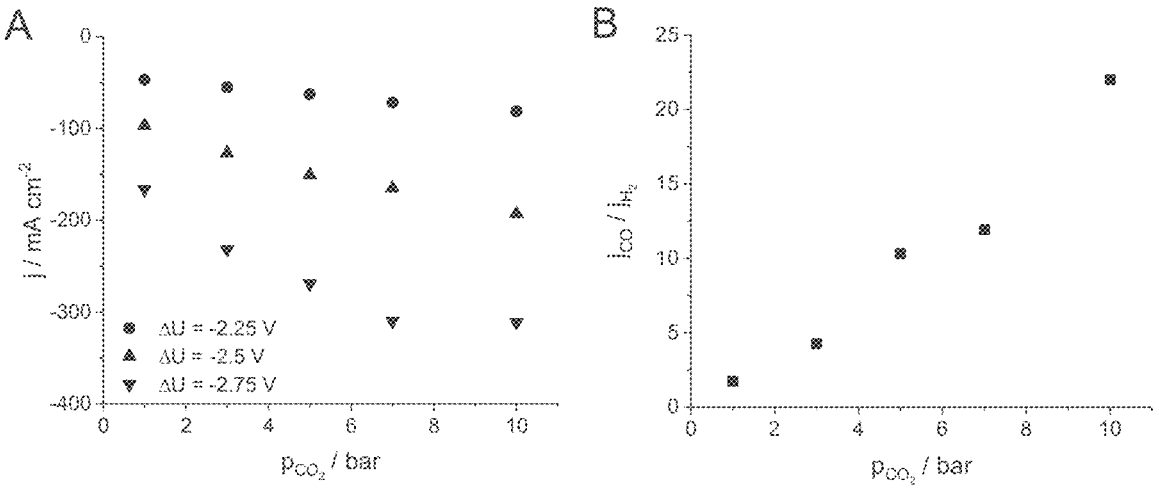
FIG. 24 shows current densities at different stack voltages (plot A) and the ratio of the partial current densities (plot B) during electrolysis at $\Delta U=-2.75$ V, both as a function of the differential $CO_2$ pressure.

Furthermore, FIG. 24 shows current densities at different stack voltages (plot A) and the ratio of the partial current densities (plot B) during electrolysis at ΔU=−2.75 V, both as a function of the differential $CO_2$ pressure prevailing in the electrolyzer stack when it continuously operates. Again, as for the cathode, 3 mg $cm^{-2}$ Ag cathode catalyst layer was immobilized on Sigracet39BC carbon paper by spray coating. As for the anode, 1 mg $cm^{-2}$ Ir black was immobilized on a porous titanium frit. The measurements were performed feeding T=50° C. 1M KOH anolyte continuously to the anode compartment (at a feed rate of ~9 $cm^3$ $cm^{-2}$ $min^{-1}$), while the cathode compartment was purged with humidified (in room temperature deionized water) $CO_2$ at a flow rate of u=12.5 $cm^3$ $cm^{-2}$ $min^{-1}$.

FIG. 24 suggests that the selectivity for CO production is significantly increased by the increased $CO_2$ pressure. Hence, this further allows controlling the syngas product composition ($H_2$/CO ratio).

BRIEF SUMMARY

As is clear from the afore-mentioned, the present invention provides/exhibits:

- An electrochemical stack architecture for the efficient electrochemical conversion of carbon dioxide.
- Pressure handling up to 30 bar (preferably 20 bar), through the cathode-side and anode-side pressure chambers.
- Pressure tolerance, i.e. pressure applied to the electrolyzer stack improves the coordination of various stack components, sealing elements and electrical contacts by compensating the negative effects of imperfect matches in the dimensions of the components due to fabrication, and thus, results in enhanced stack performance.
- High mechanical strength components (e.g. stainless steel, titanium, metal alloys or composite material framework).
- Specific sealing system, including O-rings seated in recesses/grooves and a pressure chamber both at the anodic and the cathodic sides.
- Highly scalable stack construction, both in terms of size or physical dimensions, number of the cells and product yields due to modular construction.
- Multi-cell construction in serial and parallel gas feed (important for scaling up), meaning that the initial $CO_2$ gas stream is either (i) divided within the stack and fed to all cells (parallel conversion takes place at various cells), or (ii) the whole $CO_2$ feed go through all the cells, one after the other (serial design).
- The above two scenarios (i.e. serial or parallel gas management at the cathodic side) is realized with the same stack construction elements, just by different assembling which is ensured by the modular construction of the electrolyzer stack and the multifunctionality of the elements, in particular, of the anode-side spacer element, the very specific design of which allows the serial or parallel gas management in the same stack.
- The modularity of the stack allows to combine these two scenarios, hence to connect some of the electrolyzer cells in parallel, while others in series in the same stack.
- Modularity also ensures the use of different ion exchange membranes, gas diffusion layers and catalysts, without changing the overall architecture (but still maintaining pressure tolerance).
- High conversion rates as a consequence of
  - direct gas feed,
  - high pressure capability,
  - controlled residence time (with stack geometry),
  - specific flow patterns (central feed of $CO_2$, radial collection of products).
- Novel design for connecting multiple individual cells to each other in order to facilitate gas and liquid transport within the electrolyzer stack.
- Wide variety of catalysts are usable in the electrolyzer, including but not limited to Sn, Pb, Ag, Cu, Au, C, Fe, Co, Ni, Zn, Ti, Mn, Mo, Cr, Nb, Pt, Ir, Rh, Ru, and different binary compositions and oxides formed thereof.
- Multitude of different products formed in different compositions, including but not limited to hydrogen, carbon monoxide, ethylene, methane.
- Capability of producing, also on the industrial scale, e.g. syngas and ethylene in $CO_2$ electrolyzer stacks with Ag/C catalyst and Cu/C catalyst, respectively.
- Possibility for the optimization of the operational parameters (input flow rate, humidification, pressure, stack temperature, flow pattern and its depth, GDL compression).
- Tunable syngas composition is achievable simply by changing the stack voltage.

Furthermore, as is also clear to a person skilled in the art, the present inventive solutions, either considered alone or in any combination, are not limited to the exemplified embodiments, i.e. the electrolyzer stacks for converting gaseous carbon dioxide, but can also be applied in other electrochemical setups (such as e.g. $N_2$-reduction to ammonia).

In light of the afore-mentioned, from a technological perspective, assembling multi-cell electrolyzers similar to the one illustrated in FIG. 1 instead plurality of single-cell stacks operating in parallel decreases the capital investment costs, as the stack frame and the anolyte circulation loop has to be built only once, and the inclusion of a further cell only requires an additional bipolar plate assembly, some sealing elements and an additional membrane electrode assembly.

The invention claimed is:

1. An electrolyzer stack (100', 100") to convert gaseous carbon dioxide, CO2, to at least one gas-phase product that leaves the electrolyzer stack (100', 100"), comprising:

a cathode-side end unit (26) with a gas inlet (21), a fluid inlet (23), a fluid outlet (24) and an electrical terminal;

an anode-side end unit (27) with a gas outlet (22) and an electrical terminal;

at least two electrolyzer cells (40) sandwiched between the cathode-side end unit (26) and the anode-side end unit (27), individual ones of the at least two electrolyzer cells (40) comprising:

a cathode current collector (5; 5*a*, 5*b*, 5*c*, 5*d*);

an anode current collector (10);

a membrane electrode assembly comprising:

an ion-exchange membrane (7) with a first side and a second side, a layer of cathode catalyst (6*b*) arranged on said first side in contact with the ion-exchange membrane (7), a cathode-side gas diffusion layer (6*a*) arranged on the layer of cathode catalyst (6*b*) in contact with the cathode catalyst (6*b*), a layer of anode catalyst (8*b*) arranged on said second side in contact with the ion-exchange membrane (7), an anode-side gas diffusion layer (8*a*) arranged on the layer of anode catalyst (8*b*) in contact with the anode catalyst (8*b*);

a spacer element (9*a*, 9*b*) arranged between the cathode current collector (5; 5*a*, 5*b*, 5*c*,5*d*) and the anode current collector (10), wherein said spacer element (9*a*, 9*b*) is configured to fix the membrane electrode assembly between the cathode current collector (5; 5*a*, 5*b*, 5*c*, 5*d*) and the anode current collector (10), wherein the cathode-side gas diffusion layer (6*a*) is in partial contact with the cathode current collector (5; 5*a*, 5*b*, 5*c*, 5*d*) thereby forming a cathode-side in-plane flow structure (5") therebetween, and the anode-side gas diffusion layer (8*a*) is in partial contact with the anode current collector (10) thereby forming an anode-side in-plane flow structure (5') therebetween;

a sealed continuous cell gas flow path extending between a cell gas inlet (46) and a cell gas outlet (47) within the electrolyzer cell (40) through the cathode-side flow structure (5");

a sealed continuous cell fluid flow path extending between a cell fluid inlet (48) and a cell fluid outlet (49) within the electrolyzer cell (40) through the anode-side flow structure (5');

wherein the electrical terminal of the cathode-side end unit (26), the at least two electrolyzer cells (40) and the electrical terminal of the anode-side end unit (27) are connected electrically in series; and wherein the cell gas flow paths of the at least two electrolyzer cells (40) with gas transport channels (34, 35) extending between adjacent ones of the at least two electrolyzer cells (40) through the cathode current collector (5; 5*a*, 5*b*, 5*c*, 5*d*), the spacer element (9*a*, 9*b*) and the anode current collector (10) form a continuous gas flow path that extends from the gas inlet (21) to the gas outlet (22) to supply CO2 to ones of the cathode-side gas diffusion layers (6*a*) to convert the CO2 to the gas-phase product via at least one cathodic electrolysis reaction taking place in the cathode-side flow structure (5") of the at least two electrolyzer cells (40), and to discharge the product through said gas outlet (22), and wherein the cell fluid flow paths of the at least two electrolyzer cells (40) include fluid transport channels (38, 39) extending between the adjacent ones of the at least two electrolyzer cells (40) through the cathode current collector (5; 5*a*, 5*b*, 5*c*, 5*d*), the spacer element (9*a*, 9*b*) and the anode current collector (10) form a continuous fluid flow path that extends from the fluid inlet (23) to the fluid outlet (24) to supply a liquid-phase anolyte to each of the anode-side in-plane flow structure (5') to complete said cathodic electrolysis reaction with at least one anodic electrolysis reaction taking place at the anode-side in-plane flow structure (5') of the at least two electrolyzer cells (40), and to discharge the liquid-phase anolyte and reaction product (s) forming in said anodic electrolysis reaction through said fluid outlet (24).

2. The electrolyzer stack (100', 100") according to claim 1, wherein:

at least a part of the cell gas flow paths of the at least two electrolyzer cells (40) is connected to one another in series; or at least a part of the cell gas flow paths of the at least two electrolyzer cells (40) is connected to one another in parallel.

3. The electrolyzer stack (100', 100") according to claim 2, wherein the spacer element (9*a*, 9*b*) comprises an internal gas transport channel (36) passing therethrough in a first peripheral region of the spacer element (9*a*, 9*b*), said spacer element (9*a*, 9*b*) further comprising a second peripheral region located diametrically opposite to the first peripheral region, said second peripheral region being configured to act as means for selectively choose a way two adjacent cell flow paths of the cell gas flow paths connect to one another in the continuous gas flow path of the electrolyzer stack (100', 100"), said means being provided as a further internal gas transport channel (36) in the second peripheral region.

4. The electrolyzer stack (100', 100") according to claim 1, wherein an assemblage assisting recess (52) is formed in a peripheral edge of the cathode-side end unit (26), the anode-side end unit (27), the cathode current collector (5; 5*a*, 5*b*, 5*c*, 5*d*), the spacer element (9*a*, 9*b*) and the anode current collector (10) of the at least two electrolyzer cells (40) of the electrolyzer stack (100', 100") to assist assembling/reassembling of the stack (100', 100").

5. The electrolyzer stack (100', 100") according to claim 1, wherein a cathode-side pressure chamber (31) is formed in the cathode-side end unit (26), and an anode-side pressure chamber (32) is formed in the anode-side end unit (27), wherein said continuous gas flow path is directed through the cathode-side pressure chamber (31) and the anode-side pressure chamber (32) to provide adaptive pressure control on the electrolyzer cells (40) and thus to provide uniform pressure distribution throughout said electrolyzer cells (40).

6. The electrolyzer stack (100', 100") according to claim 1, wherein the cathode current collector (5; 5*a*, 5*b*, 5*c*, 5*d*) of individual ones of the at least two electrolyzer cells (40) is formed as a second component (40*b*) of a two-component bipolar plate assembly (40'), and the anode current collector (10) of the individual ones of the at least two electrolyzer cells (40) is formed as a first component (40*a*) of the two-component bipolar plate assembly (40').

7. The electrolyzer stack (100', 100") according to claim 6, wherein the second component (40*b*) of the two-component bipolar plate assembly (40') comprises a system of the cathode-side in-plane flow structure (5") in a surface thereof facing the ion-exchange membrane (7).

8. The electrolyzer stack (100', 100") according to claim 6, wherein the first component (40*a*) of the two-component bipolar plate assembly (40') comprises a system of the anode-side in-plane flow structure (5') in a surface thereof facing the ion-exchange membrane (7).

9. The electrolyzer stack (100', 100") according to claim 6, wherein said first and second components (40*a*, 40*b*) of the two-component bipolar plate assembly (40') further comprise ports (41, 42, 43, 44, 46, 47, 48, 49) and respective cavities (33*a*, 33*b*, 33*c*, 33*d*) fully surrounding said ports for fluid/gas communication between opposite side surfaces of said first and second components (40*a*, 40*b*).

10. The electrolyzer stack (100', 100") according to claim 9, wherein the cavities (33*a*, 33*b*, 33*c*, 33*d*) are sealed separately when the stack (100, 100") is assembled.

11. The electrolyzer stack (100', 100") according to claim 1, wherein the anode-side gas diffusion layer (8*a*) of individual ones of the at least two electrolyzer cells (40) is chosen from a group consisting of Ti-frits in a form of pressed Ti powder of different average particle size, Ni-frits in a form of pressed Ni powder of different average particle size, Ti-mesh and Ni-mesh.

12. The electrolyzer stack (100', 100") according to claim 1, wherein the cathode catalyst (6*b*) is chosen from a group consisting of Ag/C catalysts and Cu/C catalysts.

13. The electrolyzer stack (100', 100") according to claim 1, wherein the anode catalyst (8*b*) is chosen from a group consisting of IrOx, RuOx, NiOx and TiOx.

14. The electrolyzer stack (100', 100") according to claim 1, wherein the at least two electrolyzer cells (40) include at most ten of the electrolyzer cells (40).

15. An electrolyzer setup (200) to convert gaseous carbon dioxide, CO2, to at least one gas-phase product, the setup (200) comprising:

an electrolyzer stack (100', 100") according to claim 1;

a source (201) of gaseous CO2; a source of liquid anolyte (213);

an external power source (220) with a first pole of a first electrical charge and a second pole of a second electrical charge, the second electrical charge being opposite in sign compared to the first electrical charge; the first pole electrically coupled to the electrical terminal of the cathode-side end unit (26) of the electrolyzer stack (100', 100") and the second pole electrically coupled to the electrical terminal of the anode-side end unit (27) of the electrolyzer stack (100', 100");

a cathode-side circulation assembly configured to circulate the gaseous CO2 from said source (201) of gaseous CO2 through the continuous gas flow path of the electrolyzer stack (100', 100") to at least one product receptacle; and an anode-side circulation assembly configured to circulate the liquid anolyte (213) from said source of liquid anolyte (213) and through the continuous fluid flow path of the electrolyzer stack (100', 100").

16. The electrolyzer setup (200) according to claim 15, wherein the cathode-side circulation assembly further comprises a humidifier (203) arranged upstream of the electrolyzer stack (100', 100") and configured to humidify the gaseous CO2 from said source (201) of gaseous CO2 before being supplied into the electrolyzer stack (100', 100").

17. The electrolyzer setup (200) according to claim 15, wherein the cathode-side circulation assembly further comprises a back-pressure regulator (209) arranged downstream of the electrolyzer stack (100', 100") and configured to increase a pressure difference prevailing in the electrolyzer stack (100', 100").

18. The electrolyzer setup (200) according to claim 15, wherein the cathode-side circulation assembly further comprises a water separator (208) arranged downstream of the electrolyzer stack (100', 100") and upstream of a back-pressure regulator (209) and configured to remove moisture from the gas-phase product.

19. The electrolyzer setup (200) according to claim 15, wherein the anode-side circulation assembly further comprises a liquid anolyte refreshing unit (211) configured to refresh the liquid anolyte (213) and/or to separate the reaction product(s) forming in the anodic electrolysis reaction(s) from the liquid anolyte (213).

20. The electrolyzer setup (200) according to claim 19, wherein the anolyte refresher unit (211) is in thermal coupling with a tempering means (212) to adjust a temperature of the liquid anolyte (213).

21. The electrolyzer setup (200) according to claim 15, wherein the liquid anolyte (203) is an aqueous KOH solution.

22. A method to convert gaseous carbon dioxide, CO2, to at least one gas-phase product, the method comprising:

circulating the gaseous CO2 through an electrolyzer stack (100', 100") according to claim 1;

simultaneously with the circulating gaseous CO2, circulating liquid anolyte (213) through the electrolyzer stack (100', 100"); and while keeping the gaseous CO2 and the liquid anolyte (213) in circulation, performing cathodic electrolysis reactions and anodic electrolysis reactions in the electrolyzer stack (100', 100") to convert the gaseous CO2, in continuous flow, to the at least one gas-phase product;

separating the at least one gas-phase product from the gaseous CO2; and discharging the at least one gas-phase product.

23. The method according to claim 22, further comprising using an Ag/C cathode catalyst to produce a mixture of hydrogen and carbon monoxide as the gas-phase product.

24. The method according to claim 22, further comprising using a Cu/C cathode catalyst produce ethylene as the gas-phase product.

25. The method according to claim 22, further comprising refreshing the liquid anolyte (213).

* * * * *